United States Patent [19]

Meyers

[11] 4,392,891

[45] Jul. 12, 1983

[54] DISHWASHER SOIL COLLECTING CIRCUIT

[75] Inventor: Theodore F. Meyers, Troy, Ohio

[73] Assignee: Hobart Corporation, Troy, Ohio

[21] Appl. No.: 319,831

[22] Filed: Nov. 9, 1981

Related U.S. Application Data

[63] Continuation-in-part of Ser. No. 165,467, Jul. 2, 1980, abandoned, which is a continuation-in-part of Ser. No. 974,342, Dec. 29, 1978, abandoned.

[51] Int. Cl.[3] ..... B08B 3/02; B08B 7/04

[52] U.S. Cl. ..... 134/10; 134/25.2; 134/104; 134/111

[58] Field of Search ..... 134/10, 25.2, 104, 109, 134/110, 111

[56] References Cited

U.S. PATENT DOCUMENTS

| | | | |
|---|---|---|---|
| 2,629,391 | 2/1953 | Hummel | 134/110 |
| 2,681,658 | 6/1954 | Meeker et al. | 134/111 |
| 2,828,083 | 3/1958 | Macemon | 241/46 |
| 2,828,084 | 3/1958 | James | 241/46 |
| 2,828,086 | 3/1958 | Macemon | 241/100.5 |
| 2,836,369 | 5/1958 | Strehlow et al. | 241/46 |
| 2,862,510 | 12/1958 | Geiger et al. | 134/111 |
| 2,879,026 | 3/1959 | Meeker et al. | 251/291 |
| 2,959,179 | 11/1960 | Sasnett et al. | 134/186 |
| 2,961,862 | 11/1960 | Smith | 68/18 |
| 3,064,661 | 11/1962 | Jacobs | 134/58 |
| 3,071,328 | 1/1963 | Higer | 241/46 |
| 3,079,094 | 2/1963 | Brezosky et al. | 241/46 |
| 3,080,742 | 3/1963 | Toma | 68/12 |
| 3,080,874 | 3/1963 | Brucken | 134/115 |
| 3,103,225 | 9/1963 | Schmitt-Matzen | 134/58 |
| 3,179,307 | 4/1965 | Duncan et al. | 222/333 |
| 3,282,427 | 11/1966 | Mandarino et al. | 210/108 |
| 3,310,243 | 3/1967 | Duncan et al. | 241/101 |
| 3,313,311 | 4/1967 | Gilson | 134/109 |
| 3,323,529 | 6/1967 | Geiger et al. | 134/104 |
| 3,356,097 | 12/1967 | Schaap | 134/112 |
| 3,370,598 | 2/1968 | Lopp et al. | 134/111 |
| 3,421,704 | 1/1969 | Peyer et al. | 241/46.11 |
| 3,425,355 | 2/1969 | La Flame et al. | 103/3 |
| 3,434,671 | 3/1969 | Cushing et al. | 241/46 |
| 3,457,929 | 7/1969 | Madden | 134/111 X |
| 3,549,294 | 12/1970 | Kerr et al. | 134/58 |
| 3,653,807 | 4/1972 | Platt | 8/158 |
| 3,765,430 | 10/1973 | Muller | 134/109 |
| 3,774,418 | 11/1973 | Ohmann | 68/18 F |
| 3,807,419 | 4/1974 | Cushing et al. | 134/104 |
| 3,810,480 | 5/1974 | Smith et al. | 134/104 |
| 3,989,054 | 11/1976 | Mercer | 134/104 |
| 4,038,103 | 7/1977 | Grunewald | 134/10 |
| 4,097,307 | 6/1978 | Geiger | 134/111 X |
| 4,150,679 | 4/1979 | Cushing et al. | 134/104 |
| 4,150,680 | 4/1979 | Johnson et al. | 134/104 |
| 4,164,430 | 8/1979 | Reinwald et al. | 134/13 |
| 4,168,715 | 9/1979 | Spiegel et al. | 134/104 |
| 4,228,962 | 10/1980 | Dingler et al. | 241/46 R |
| 4,243,431 | 1/1981 | Dingler et al. | 134/104 |

OTHER PUBLICATIONS

"A Dishwasher Designed for Dependability", *Appliance,* May 1978, p. 44.

Page from a General Electric Dishwasher Service Manual.

"Removing Solids From Process Liquids", *Plant Engineering,* Nov. 24, 1977, p. 80.

*Primary Examiner*—Marc L. Caroff

*Attorney, Agent, or Firm*—Biebel, French & Nauman

[57] ABSTRACT

A dishwasher such as a domestic dishwashing machine has a first recirculating path for recirculating wash and rinse fluids through nozzles which spray the fluid onto food ware items in the wash chamber of the warewasher. Fluid is also circulated from the wash chamber through a soil collecting circuit which conducts fluid to a soil collector which is separate from the wash chamber and recirculating path. The soil collector removes food soil from fluid passing therethrough and holds it for discharge into the dishwasher drain system when the fluids are drained from the dishwasher.

23 Claims, 25 Drawing Figures

FIG-16
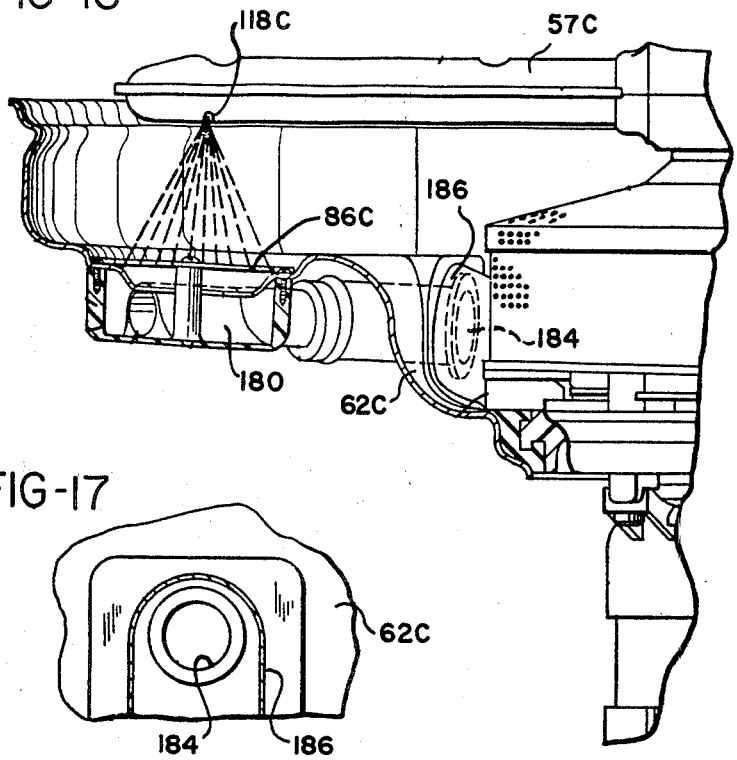
FIG-17
FIG-18
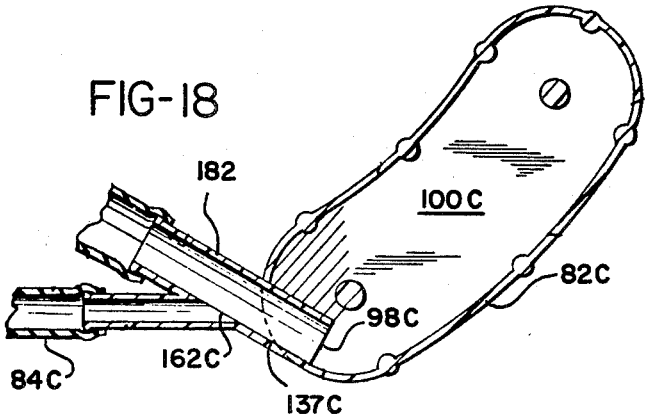

DISHWASHER SOIL COLLECTING CIRCUIT

CROSS-REFERENCE TO RELATED APPLICATION

This is a continuation-in-part of U.S. Application Ser. No. 165,467, filed July 2, 1980, now abandoned, which is a continuation-in-part of U.S. Application Ser. No. 974,342, filed Dec. 29, 1978, now abandoned.

BACKGROUND OF THE INVENTION

The present invention relates to warewashing machines, and more particularly, to domestic or household-type dishwashers. Food ware is cleaned in such machines by a sequence of one or more wash and rinse periods under the control of a timer. During a wash period, water and detergent are introduced into the wash chamber of the dishwasher, and this wash fluid is sprayed under pressure onto the food ware by a recirculating pump which pumps the wash fluid through the nozzles of a rotating wash arm system. At the end of each wash period the soiled wash fluid is drained. For rinsing, clean water alone is introduced into the wash chamber, and this rinse fluid is also recirculated and sprayed onto the food ware items, and then drained. Normally, several rinses are required.

Such machines generally have several different operational modes or "cycles", with the number of wash and rinse periods for each being determined by the soil conditions and the quantities or types of articles typically washed in such a cycle. For example, a dishwasher such as shown in U.S. Pat. No. 3,549,294 (assigned to the assignee of the present invention) enables the machine operator to select any of several wash cycles having different time periods and different numbers of wash and rinse periods. In the '294 machine, a Normal Wash is typically used to clean dishes, glasses, and other dinnerware, while a Soak cycle is preferably used for removing heavily baked-on encrustations from pots, pans, or casserole dishes which have been used in cooking or baking. While the total quantity of food soil removed during any particular cycle is related, of course, to the number of food ware items placed within the warewasher and the extent to which the machine operator may already have scraped food soil from the items before placing them in the warewasher, it is normally expected that more soil will be removed during a Soak cycle than during a Normal cycle. As a result, a Soak cycle will typically include a static soak period and more wash and/or rinse periods than a Normal cycle.

The need for several wash and rinse periods results from using the same single wash chamber and recirculating and spraying system for both the washing and rinsing phases of the warewashing operation. No matter how well the fluid may be filtered as it is used, some of the food soil unavoidably becomes suspended within the fluid and then passes continually through the recirculating pump and spraying system as the fluids are being sprayed onto the food ware items. Many of these food soil particles are then redeposited onto the food ware items as they are being washed and/or rinsed. Some also remain behind on the walls of the wash chamber and within the recirculating pump and spray arms. Multiple rinse periods help reduce this redeposit problem, since, during each rinse period, fresh water is introduced, sprayed, and then drained, so that less and less of this fine soil remains, and less and less is redeposited.

In a common method of washing dishes in a domestic dishwashing machine the fluid which is sprayed onto the food ware is first finely filtered of soil to enable the use of small wash arm orifices (typically as small as 4 mm across) and a fairly high pressure pump. Without fine filtering, small orifices and acceptably sized pumps could not be used, and high spray pressures and velocities could not be reliably achieved, due to the likelihood of clogging such small orifices. A small orifice/high pressure system therefore usually requires a fine filter for capturing rather than recirculating the soil. Such a system also typically uses two pumps, one for pumping the filtered fluids through the wash arms, and another, located essentially upstream of the filter, for pumping the water and collected soils to a drain at the end of a wash or rinse period.

However, with systems employing a fine filter the recirculating fluid necessarily passes through food soil which has been captured by the filter. In heavy soil conditions, it is possible for the fluid flow to become sufficiently obstructed at the filter, as by partial clogging thereof, to impair the efficiency and effectiveness of the recirculating and spraying system. It is therefore desirable to remove as much of the soil as possible to a remote location separated from the recirculating and spraying system. This not only prevents clogging of the recirculating and spraying system, but also minimizes disintegration and emulsification of the food soil at the filter, caused by turbulence in the fluids, which continuously agitates the collected food soil debris.

The general principle of separate soil removal is widely recognized in a number of other fields. For example, in many oil-lubricated machines, such as internal combustion engines, in which the lubricating oil is recirculated, a portion thereof is circulated through a bypass filter, thus extending the effective life of the lubricant and of the engine or machine itself. Similarly, in the clothes washing art, an auxiliary water recirculating path is often provided to pass some of the water through a lint filter for subsequent separate removal.

Thus, the more soil removed from the primary recirculating and spray system within the warewasher, and the faster it is removed, the fewer wash and/or rinse cycles—and hence the less hot water—required. Further, by prolonging the usefulness of the water, early soil separation and removal can reduce the amount of hot water needed in each particular period. As a result, energy and water savings can be realized both in the quantity of water consumed during each wash or rinse period, and in the total number of periods required.

The prior art relating to domestic dishwashing machines includes several examples of filters intended to supply the advantages of a bypass filter in accordance with the above discussion. However, they are generally only partially effective, or require servicing by the machine operator, or both. Preferably, such a system should remove large as well as small soil particles from the recirculating and spray system as quickly as possible (without first requiring them to pass through the recirculating spray system itself), and should flush them completely down the drain during draining of the fluid from the warewasher, with essentially no intervention or assistance from the machine operator.

SUMMARY OF THE INVENTION

Briefly, the present invention meets the above needs and purposes by providing an inexpensive, highly effective soil collecting circuit which draws food soil laden wash and rinse fluids from the sump of the wash chamber, passes them through a soil collector body where the food soil is filtered out and retained therein, and returns the filtered fluid ("supernatant") to be circulated through the primary spray means.

The soil collecting circuit is independent of the primary spray means within the wash chamber. That is, a typical domestic dishwasher will have one or more spray arms which receive pressurized wash or rinse fluids from a recirculating or wash pump and spray the fluids onto the food ware within the wash chamber of the dishwasher. In such a machine, the wash arms are the primary spray means since they are responsible for and provide the pressurized fluid spray which impinges on the food ware to clean and rinse them. Some dishwashing machines also include other sprayers or sprinklers to supplement the action of the primary spray means, and these can be distinguished by the fact that the manufacturer would consider the supplementary spray members to be helpful but not essential for satisfactory operation of the dishwasher, while the primary spray means is considered essential and necessary.

In the embodiments of the invention, the dishwasher has a circulating system consisting of two pumps: a recirculating pump and a drain pump. While the recirculating pump functions as part of the aforementioned primary spray means, the drain pump is part of a drain system having a drain pump inlet adjacent the bottom of the sump and a drain outlet communicating with a drain. The soil collecting circuit of the present invention includes a circuit inlet common with the drain pump inlet so that soil laden fluid may be drawn from the sump and pumped to the collector body. Thus, the recirculating pump and primary spray means are independent of the soil collecting circuit and soil collector body. The recirculating pump may be reserved for supplying high pressure wash and rinse fluids to the spray arms alone, and the drain pump utilized to supply fluid independently to the soil collecting circuit, or to drain the soil collecting circuit and sump of fluid and food soil.

The soil collector body is located in a portion of the fluid bypass circuit which is separated from the wash chamber in order to remove the food soil debris from the wash chamber as quickly as possible, to retain it outside the wash chamber, and to protect it from the emulsifying and disintegrating forces of the wash and rinse fluids within the wash chamber as they are being distributed by the primary spray arms. In this sense, the soil collector could be inside the actual dishwasher tank so long as the soil collector defined a protected volume or space which was separated from the remaining volume of the tank. In that case, it would not be possible to place food ware within the volume of the soil collector, so the volume of the soil collector would not form a portion of the volume of the wash chamber. Instead, the volume of the tank would actually be greater than the volume of the wash chamber.

Another advantage of the independence of the soil collecting circuit from the primary spray means is that the soil collecting circuit and soil collector body can accept pieces of food soil much larger than that allowed to enter the spray arms which can accept particles no larger than the spray orifices therein without becoming clogged. On the other hand, the soil collecting circuit and soil collector body can accept food soil sizes close to the size of the drain line in the dishwashing machine.

In the embodiments of the invention, the inlet to the soil collecting circuit and drain system is at the very bottom of the wash chamber. Since most dishwashing machines have sumps, the inlet to the soil collecting circuit is typically at the bottom of the sump so that the food soil washed from the food ware settling to the bottom of the wash chamber can be removed quickly.

The soil collector body and collecting circuit are operable in two modes, a soil collecting mode and a soil discharging mode. In the soil collecting mode the wash or rinse fluids are pumped from the sump to the soil collector body, which filters food soil from the fluids and collects and holds it for subsequent discharge from the dishwashing machine. In the soil discharging mode collected food soil is discharged from the soil collector body and soil collecting circuit back to the sump. The soil collecting circuit is operated in the soil discharging mode whenever the drain system of the dishwashing machine is operated in a draining mode in which wash or rinse fluids are drained out through a drain line in the drain system to a drain. During the draining mode, the soil collecting circuit discharges the collected food soil to the sump proximate the drain inlet so that it passes directly out through the drain line. During the recirculating mode when the wash or rinse fluids are being recirculated within the dishwashing machine, the soil collecting circuit is operated in the soil collecting mode to provide simultaneous and continuous filtering of the fluids by the soil collector body.

Thus, the soil collecting circuit provides bi-directional fluid flow during a complete washing cycle. Soil laden fluid is pumped through the circuit in one direction from the sump to the collector body during the soil collecting mode, then is permitted to drain from the collector body during the soil discharging mode, traveling in the opposite direction through part of the collecting circuit to the sump. The debris outlet of the collector body comprises a common fluid channel with the portion of the collecting circuit removed from the wash chamber. Consequently, the entire food soil collection and disposal system is contained within a single conduit linking the collector body with the drain system.

In each of the embodiments, the collector body is elevated above the drain pump inlet and sump so that fluid and soil may be drained from the collector body by gravity flow. In order to maintain the food soil within the body during the soil collecting mode, the collecting circuit includes a nozzle or venturi upstream of the collector body. During the soil collecting mode, the drain pump pumps fluid and food soil through the nozzle and into the body, creating a relatively high velocity stream of fluid entering the collector body that prevents reverse flow of fluid and food soil from the collector body. During the soil draining mode, output of the drain pump is directed through the drain system toward the drain outlet and not to the common fluid channel, allowing the contents of the collector body to be flushed to the sump and ultimately to the drain inlet.

The nozzle is located in a section of the soil collecting circuit adjacent the debris outlet of the collector body, which is in fluid communication with the sump. During the soil collecting mode in all but one of the embodiments, the stream of fluid through the nozzle causes soil-laden fluid to flow upwardly from the sump and through the debris outlet, to become entrained in the stream and flow to the collector body. Thus, the nozzle acts as a secondary pump during the soil collecting mode.

In three of the embodiments, the collector body, recirculating pump, and drain pump are located within a single pump housing mounted concentrically within the sump, below the wash arms of the primary spray means. Preferably the collector body is superposed to the recirculating pump so that the filter screen covering the outlet of the body is positioned directly below the wash arms. The drain pump is positioned directly below the recirculating pump so that the common soil collecting circuit and drain inlet can receive fluid and soil from the lowest level of the sump.

Another advantage of the single housing is that only a single opening is required in the wash chamber which must be sealed against fluid leakage. The single housing also minimizes the lengths of conduit required to link the components of the system together. Indeed, some of the conduits in the three aforementioned embodiments may be molded as an integral part of the housing.

In the three aforementioned embodiments, the drain pump includes an impeller that comminutes or grinds the larger particles of food soil entering the drain/soil collecting circuit inlet throughout the recirculating mode. Thus, food soil entering the collector body from the collecting circuit inlet is ground first. During the soil discharging mode, all the food soil present in the fluid in the sump, including that drained from the collector body, which passes through the drain/soil collecting circuit inlet, is ground by the drain pump impeller prior to entering the drain system. Thus, the food soil entering the drain during the soil discharging mode has been ground thoroughly before entering the drain line, minimizing the possibility of the drain system clogging. At the same time, the invention effects early and rapid removal of food soil from the fluid in the sump by the fluid bypass circuit to avoid unnecessary and excessive disintegration of the food soil which would result if ground debris were simply recirculated within the wash chamber.

The preferred embodiment of the invention preferably is used in combination with a recirculating pump of the type having an inlet located within the sump enclosed by a fine mesh main or inlet screen to filter fluid entering from the sump to a recirculating pump impeller. The main screen is closed at its top by a shroud so that the shroud and main screen enclose the recirculating pump inlet and fluid outlet of the soil collector body. During the recirculating and soil collecting mode, fluid is pumped through the soil collecting circuit, filtered in the collector body, and passes directly to the recirculating pump inlet behind the main screen. By depositing the effluent from the collector body behind the main screen, less fluid is needed to supply the recirculating pump from the sump, reducing the load on the main screen.

The drain pump impeller is mounted on a common drive shaft with the recirculating pump impeller. The two impellers are preferably driven by a reversible motor and, when operated in a forward direction, the recirculating impeller operates in the circulating mode and the drain impeller operates in the soil collecting mode.

When the pump motor is operated in the reverse direction, the recirculating pump continues to operate in the recirculating mode and the drain pump operates in the soil discharging mode. The recirculating pump continues to pump fluid through the spray arms to the sump until the fluid level drops below the inlet to the circulating pump and the pump starves. Fluid and food soil begins to flow from the soil collector body to the sump adjacent the drain inlet as soon as the motor is reversed because the venturi effect has stopped. Spray jets formed in the shroud and in fluid communication with the spray arms of the primary spray means direct water upon the filter screen of the collector and act during the soil discharging mode to flush the retained food particles from the soil collector body. By implementing a reversible motor which drives the drain impeller, the same fluid channel can be used in both the soil collecting mode and the soil discharging mode, thus keeping food soil from the wash chamber at all times during the washing and draining cycles.

In an alternate embodiment, the shroud is absent and the main screen of the recirculating pump is joined to the pump housing by a flange extending radially about the side wall of the pump housing below the fluid outlet of the soil collector body. Thus, during the soil collecting mode of the drain pump, fluid is pumped through the soil collector body and out through the fluid outlet where it flows downwardly adjacent the main screen into the sump where it may be drawn through the main screen to the recirculating pump.

The spray jets are formed in the wash arms and may consist merely of openings in a lower surface of each wash arm positioned to direct fluid downwardly upon the collector screen. The spray jets may function both to promote draining of the soil collector body and to prevent clogging of the collector screen during the soil collecting mode.

If it is not desired to equip the dishwasher with a reversible motor, an alternate embodiment can be implemented which still retains the advantages of the single pump housing. For example, in a second alternate embodiment of the invention, the drain pump communicates with the nozzle and soil collector body by a fluid inlet conduit, a part of which forms the drain line. A diverter valve mounted on the fluid inlet conduit diverts fluid flowing through the inlet conduit to the collector body during the soil collecting mode and diverts the fluid to the remainder of the drain line and out of the common segment of the soil collecting circuit during the soil discharging mode. As in the previously discussed embodiment, spray jets mounted on the spray arms serve to flush the collected food debris from the soil collector body.

Thus, in this third embodiment, the soil collecting circuit comprises the drain inlet, drain pump, fluid inlet conduit and valve, nozzle, common fluid channel, and soil collector body. Coincidental with a portion of the bypass circuit is the drain system which extends from the drain inlet to the drain line. Again, food soil debris, once removed from the wash chamber and retained within the collector body, does not re-enter the wash chamber at any time during the washing cycles.

In another embodiment, the invention is modified so that the soil collector body is recessed within the floor of the wash chamber remotely from the recirculating pump housing and lower housing portions, and the drain impeller performs a modified comminuting function. The soil collector body has an upwardly open hollow interior which is attached to the underside of a correspondingly-shaped opening in the wash chamber bottom. The fine mesh collector screen is mounted at the interface between the soil collector body and the wash chamber opening, the screen and the upwardly opened hollow interior of the collector body defining a soil collecting compartment. The soil collecting circuit in this embodiment extends from the drain inlet through the drain pump and fluid inlet conduit to the common fluid channel communicating with the soil collecting compartment of the collector body. The debris outlet extends from the soil collector body to an area in the sump proximate the drain inlet. The debris outlet merges with the fluid inlet conduit to form a common opening at the bottom of the collector body.

As in the aforementioned embodiment, a segment of the fluid inlet conduit of the soil collecting circuit also comprises a drain line and a diverter valve is mounted on the circuit at a point intermediate the drain impeller and the collector body so that fluid can be circulated through the circuit during the soil collecting mode or diverted from the circuit to the drain line during the soil discharging mode. The point at which the fluid inlet conduit and the debris outlet conduit merge forms the nozzle.

Large food particles may be comminuted by the interaction with the edge of an inlet plate which forms the opening to the lower housing and the impeller. The comminuted particles can be stored in the soil collector body and then safely discharged out of the machine through the drain line.

In another embodiment, the nozzle formed by the inlet conduit and the debris outlet conduit of the aforementioned embodiment includes a bellows attached to the end of the inlet conduit and extending to the common opening in the soil collector body. During the soil collecting mode, the pressure of the moving fluid causes the bellows to extend and cover completely the common opening in the soil collector body, thereby preventing flow of fluid and debris from the soil collector body through the debris outlet conduit. When the dishwasher is operating in the soil discharging mode, fluid flow through the soil collecting circuit is stopped and the resiliency of the bellows causes it to retract from the common opening and permit the contents of the soil collector body to flow through the debris outlet conduit and into sump adjacent the the drain inlet and drain system. In both of the embodiments having sump-mounted soil collectors, the flushing of the soil collector body is enhanced by a spray jet formed in the underside of the spray arm and positioned so that fluid can be pumped through the recirculating pump and sprayed onto the fine mesh screen to flush the soil collector body after the fluid level in the wash chamber has fallen below the floor of the wash chamber.

It is to be expected that there will be food soil debris introduced into the warewashing machine that will be too large for the recirculating and spray system, and some which will be too large for the drain pump and soil collector in the fluid bypass circuit. Also, the debris which is removed by the bypass soil collector, regardless of its size, will not all be removed at once. Thus, in the aforementioned embodiments, the need for a main screen still exists. The main filter function is principally to prevent recirculation of food soil debris through the recirculating pump, which would result in emulsification and redepositing of debris on the food ware, and possible clogging of the water spray jets on the spray arms. The main filter thus permits the use of fine spray orifices in the spray arms.

The soil collecting circuit operates in the soil collecting mode when wash and rinse fluids are being recirculated within the dishwasher but operates exclusively in the soil draining mode when fluids are drained from the wash chamber through the drain line during the fluid draining mode of the recirculating pump. At that time, no additional food soil is collected or removed by the soil collecting circuit so that food soil wherever situated within the dishwasher may be discharged without hindrance during draining of the wash or rinse fluids. This provides an important advantage over prior art filter systems which operate in series with the primary spray means and continue to capture and entrain food soil debris at the very time it should be released to be flushed down the drain.

Thus, the present invention provides very effective early soil removal which is independent of the primary spray means. The principal aspect of the invention is to separate soil from the recirculating wash or rinse water, collect the soil at a point removed from the main dishwashing operation, and subsequently dispose of the collected soil down a sewer or drain, preferably by pumping it under positive pressure to a sink drain or a food waste disposer connected to the sink drain, and simultaneously cleansing the soil collector for its next use. Soil collection in this manner improves main recirculating pump efficiency and obtains better washing results since redeposit of food soil is substantially reduced. The captured food soil debris can be disposed of on command (by switching to the soil discharging mode). Thus, disposal of collected food soil debris may be accomplished at the end of each wash or rinse period, when the sump is drained.

As a result of the early soil removal, the present invention enables heavily soiled food ware to be cleaned with a smaller number of wash and rinse periods than previously possible. The reduction of the number of wash and rinse periods (and the utilization where possible of a smaller quantity of water for each such period) results in reduced water consumption, and where hot water is involved, a reduction also in the energy which would have been used to heat the water which has been saved. Therefore, this improvement in washing effectiveness is actually accompanied by an improvement in energy efficiency.

In the embodiments of the invention, only one or two moving parts are required: the drain impeller and, in some embodiments a valve in the collecting circuit. The invention is also very tolerant of overload conditions. That is, if the soil collecting compartment in the soil collector body should become filled, this will not interfere with operation of the primary spray means. The high pressure washing and rinsing sprays will continue to be provided for cleaning the food ware items within the warewashing machine, and the collected food soil debris will be discharged into the drain line at the end of that particular wash or rinse cycle. The nozzle of the embodiments serves as a pressure relief valve during such an overload condition to limit the pressure which develops within the soil collecting compartment. Thus, excess pressure which might extrude some of the collected food soil debris through the fine mesh screen will not develop.

It is therefore an object of the present invention to provide an improved dishwashing machine having a soil collecting circuit which is independent of the primary spray means to conduct fluid from the wash chamber through a soil collecting circuit which is separated from the wash chamber, to remove, collect, and hold the debris therein and to return the resulting supernatant to supply the primary spray means; to provide such a combination in which the soil collector can be operated in both a soil collecting and soil discharging mode; in which the soil discharging mode causes the collected food soil debris to be discharged through the drain line; in which the removed food soil is protected from disintegration and emulsification due to recirculation and spraying of wash and rinse fluids onto the food ware items; in which the food soil is removed directly from the wash chamber without first having to pass through or be propelled by the primary spray means; and to provide the above objects and purposes in an inexpensive, versatile, and reliable configuration readily suited for use in a wide variety of dishwashing machines.

Other objects and advantages of the invention will be apparent from the following description, the accompanying drawings and the appended claims.

BRIEF DESCRIPTION OF THE DRAWINGS

FIG. 16 is a cross sectional view of the soil collector of FIG. 15 taken on line 16—16 of FIG. 15;

FIG. 17 is a fragmentary cross sectional view of the soil collecting circuit taken on line 17—17 of FIG. 15;

FIG. 18 is a fragmentary cross sectional view of the soil collector of FIG. 13 taken on line 18—18 in FIG. 14;

DETAILED DESCRIPTION OF THE PREFERRED EMBODIMENTS

Figure 1:
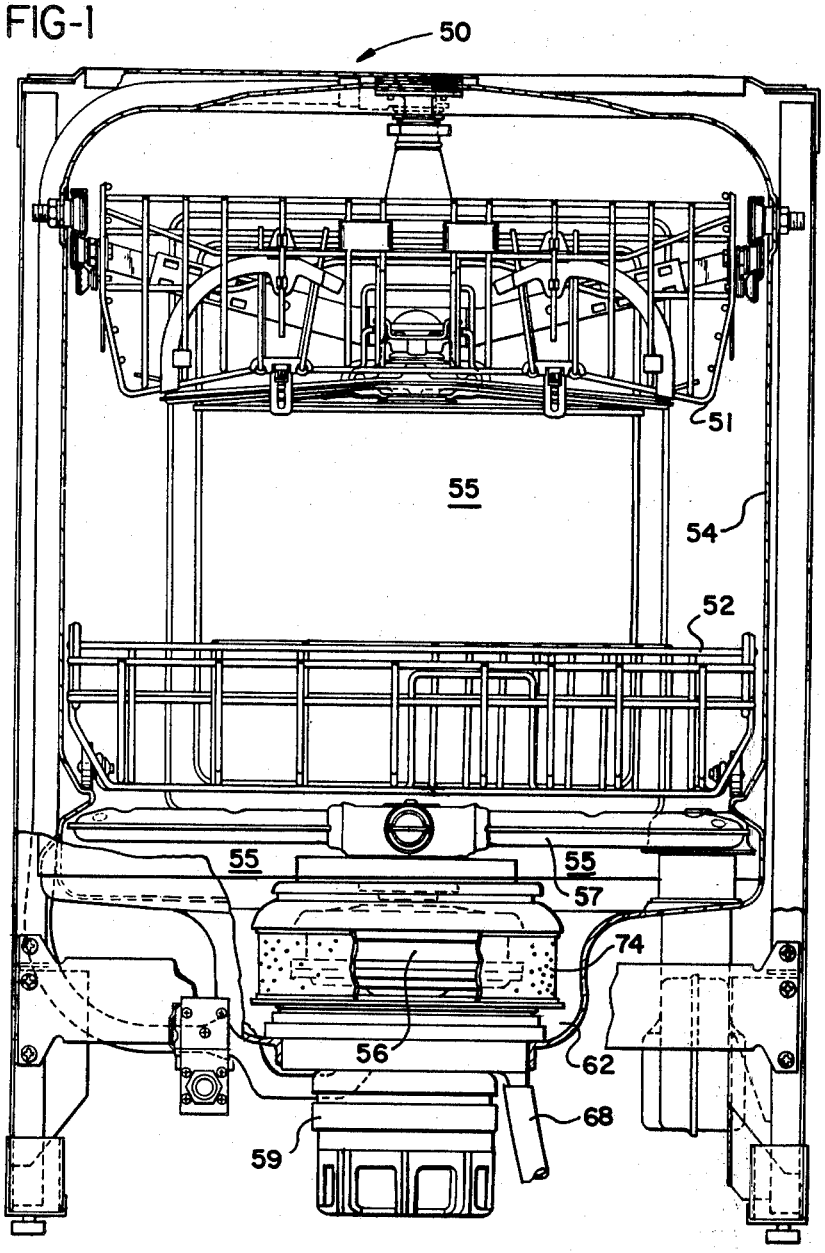
FIG. 1 is a partially broken away cross sectional elevation of a domestic dishwashing machine including a soil collecting circuit according to a preferred embodiment of the present invention.

As shown in FIG. 1, a warewashing machine such as a domestic dishwasher 50 includes conventional upper and lower racks 51 and 52 for supporting food ware, such as cups, saucers, plates, and silverware, within a tank 54. Tank 54 substantially defines the rear, bottom, sides and top of a wash chamber 55 within dishwasher 50 where the washing and rinsing of food ware takes place. The front of chamber 55 is defined by a door (not shown) which closes tank 54 during washing and rinsing of the food ware.

As shown and described in greater detail in U.S. Pat. No. 4,097,307, issued June 27, 1978, assigned to the assignee of the present invention, and incorporated herein by reference, dishwasher 50 also includes a primary spray means consisting in part of a recirculating pump 56, primary spray arms 57 mounted on fixed shaft 58 (FIG. 2) and drive motor 59 linked to a recirculating pump impeller 60 by drive shaft 61. A sump 62 in the bottom of tank 54 comprises part of wash chamber 55, and the recirculating pump 56 is positioned within this sump.

Figure 2:
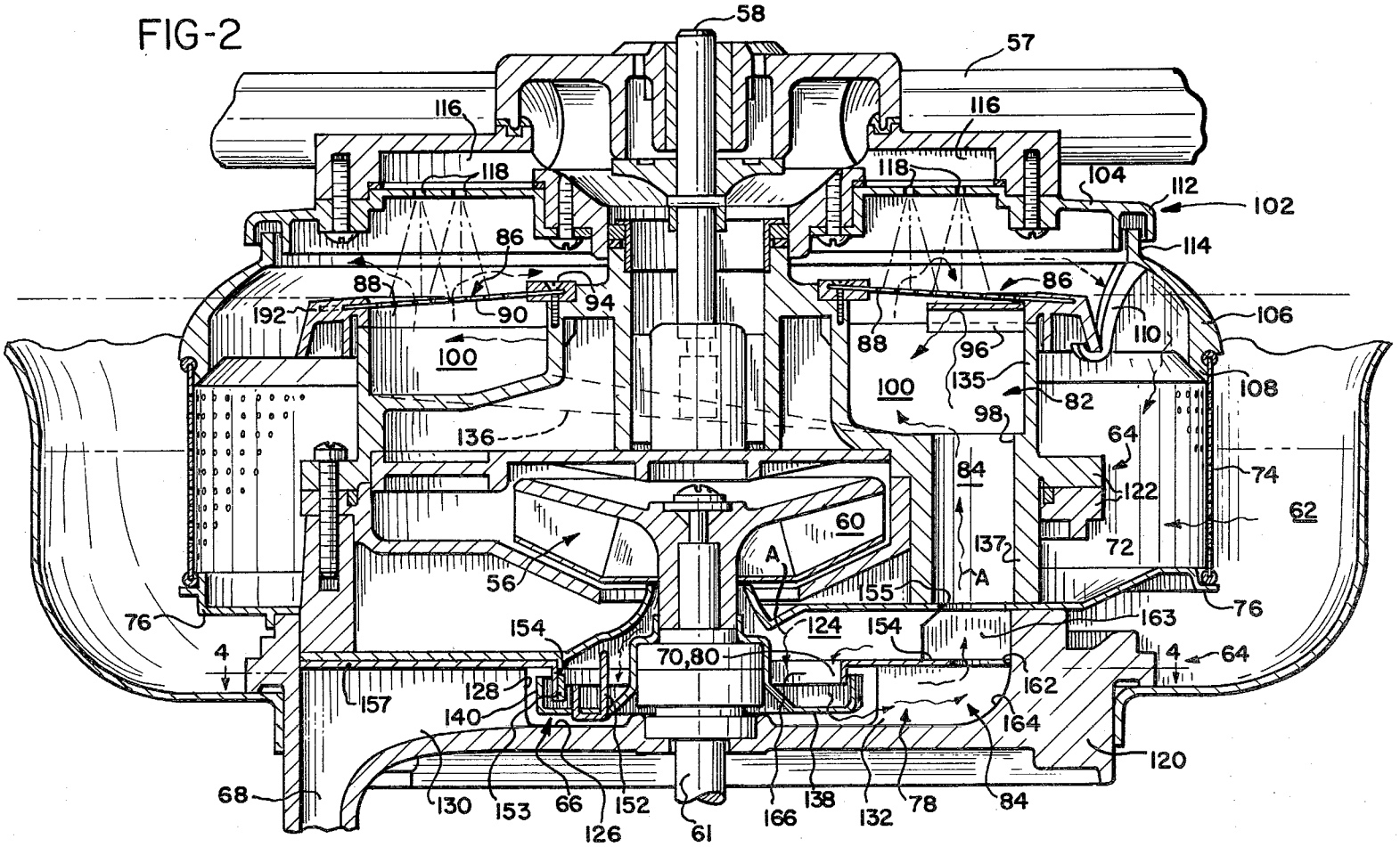
FIG. 2 is a cross sectional elevation of the soil collecting circuit of the dishwasher in FIG. 1, also showing the recirculating pump and primary spray arms.

As shown in FIGS. 1 and 2, a pump housing 64 encloses both recirculating pump 56 and a drain pump 66. Drain pump 66 is part of a drain system which has an opening in the bottom of sump 62 for receiving and draining the wash and rinse fluids from the dishwasher 50, through a drain line 68, and into a conventional household drain (not shown), for example.

In the embodiment shown in FIGS. 1 and 2, the drain pump inlet 70 is the inlet to the drain system. The recirculating pump inlet 72 is located in sump 62 slightly above the drain pump inlet 70. Inlet 72 is protected by a main filter screen 74 supported by the outer edge of a circular divider plate 76 forming a part of pump housing 64 to prevent food soil debris particles from entering the recirculating pump 56 and blocking or clogging the jet spray orifices on spray arms 57. In the preferred form the screen is made of stainless steel with holes of 0.045 inches in diameter and 37% open. It will be recognized that the description thus far of machine 50 is of well-known and conventional components commonly found in many high quality domestic dishwashing machines.

The improvement of the present invention includes a soil collecting circuit 78 which is independent of the primary spray means. Collecting circuit 78 consists in part of a circuit inlet 80, which is common with drain pump inlet 70, a soil collector body 82 integral with pump housing 64, and a fluid inlet conduit 84 extending from the inlet 70, 80 to the collector body. Soil collecting circuit 78 defines a space separated from wash chamber 55. The drain pump inlet 70, which is also the circuit inlet 80, is located substantially at the bottom of sump 62 to expedite removal of food soil as it settles to the bottom of the wash chamber 55.

The collector body 82 includes a fine filter screen 86 (also shown in FIG. 5) which covers a fluid outlet 88 that is generally annular in shape and concentric with the pump housing 64. Screen 86 preferably includes a woven nylon mesh 90 extending between and molded into a frame 92 having support spokes. Mesh 90 preferably comprises substantially square openings 0.0106 inches on a side and is 44% open. Screen 86 is retained by screws 94 to the top of the pump housing 64. As can be seen, screen 86 is of finer mesh than screen 74 for purposes which will become apparent.

A deflector plate 96 is also molded into the screen 86 and is positioned above a collector body inlet opening 98 in order to deflect fluid entering the collector body from the fluid inlet conduit 84. Plate 96 is inclined relative to the screen 86 so that fluid impinging upon its underside is deflected about the soil collector chamber 100 within the collector body 82. Deflector plate 96 prevents food soil carried by fluid entering the collector chamber 100 through opening 98 from becoming embedded in the mesh 90 of the screen 86 by impact with the screen caused by the relatively high pressure and high velocity of the fluid stream entering the chamber. Embedded food soil is more difficult to remove from the chamber 100 than food soil suspended in the fluid within the chamber. The inclined orientation of deflector plate 96 provides an additional benefit in that the high pressure stream of fluid entering the chamber 100 through opening 98 is directed laterally about the chamber, in a generally circular path. This constant circular movement of fluid through the chamber 100 during the soil collecting mode prevents accumulation of food soil at any one location in the chamber, thus facilitating the draining of food soil from the chamber during the soil draining mode.

As shown in FIG. 2, the fluid outlet 88 is enclosed by shroud means 102 which is attached to spray arms 57 and main screen 74. Shroud 102 comprises a rotatable disc-shaped inner member 104 and a stationary annular outer member 106. Outer member 106 is arcuate in section and includes a lower lip 108 which engages the main screen 74, and prongs 110 depending downwardly to engage the periphery of the frame 92 so that the outer member and screen may be supported in place by resting on the annular extension of divider plate 76 and engaging the main screen. Thus, the main screen 74 and outer member 106 may be removed easily for cleaning by lifting them upwardly away from the pump housing 64, once the spray arms 57 have been lifted off fixed shaft 58.

The inner member 104 is integral with the spray arms 57 and its outer periphery defines an inverted, U-shaped channel 112 which engages an upper rim 114 of the outer member to form a labyrinth seal. The labyrinth seal permits rotation of the inner member 104 with respect to the outer member 106 during operation of the primary spray means. Inner member 104 also includes conduits 116 having downward opening orifices 118 located above filter screen 86, and in fluid communication with the spray arms 57 and hence recirculating pump 56. Orifices 118 form spray jets to clean the filter screen 86 and promote flushing of the soil collector chamber 100.

Figure 3:
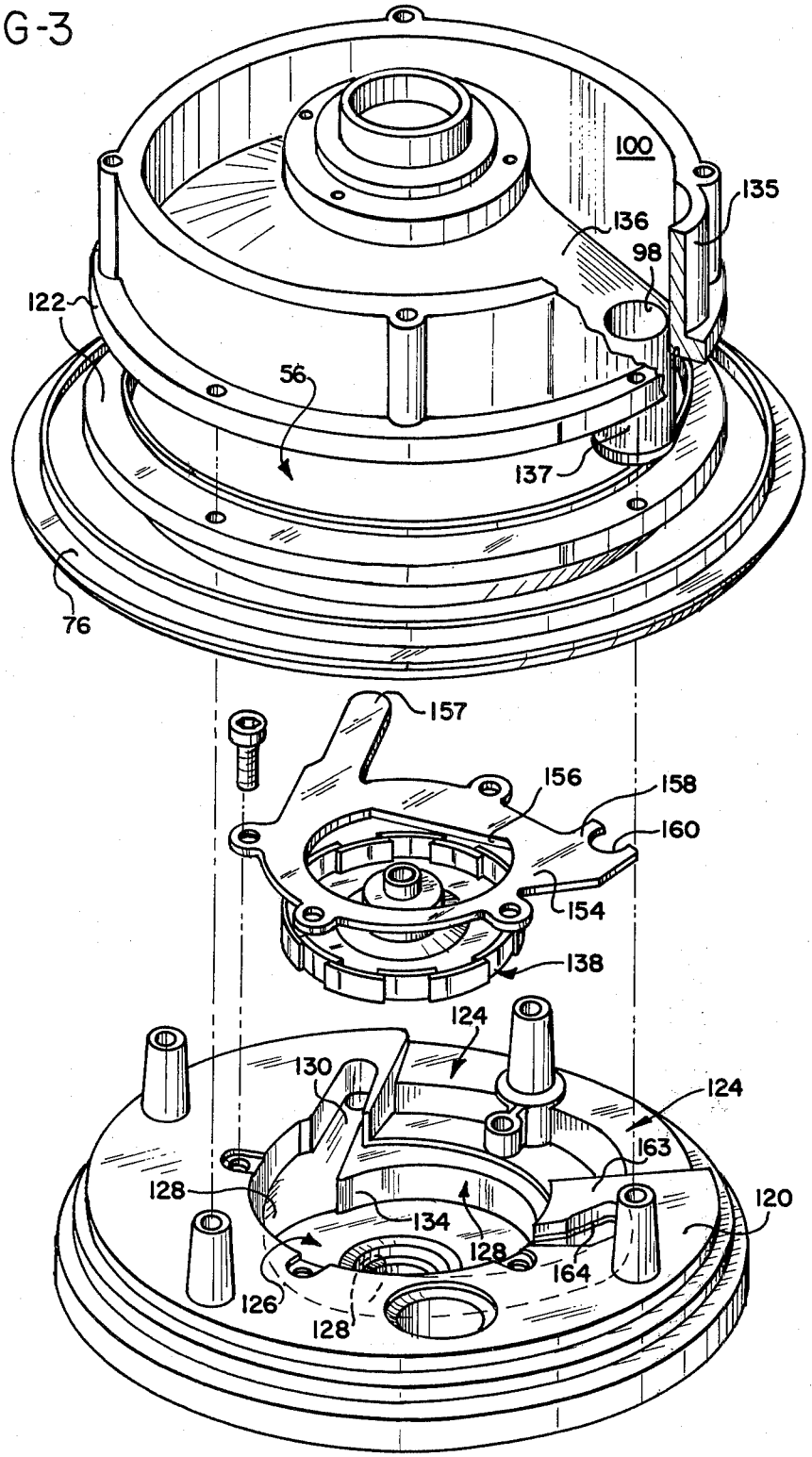
FIG. 3 is an exploded view in perspective of the soil collecting circuit of the preferred embodiment of FIG. 1.
Figure 4:
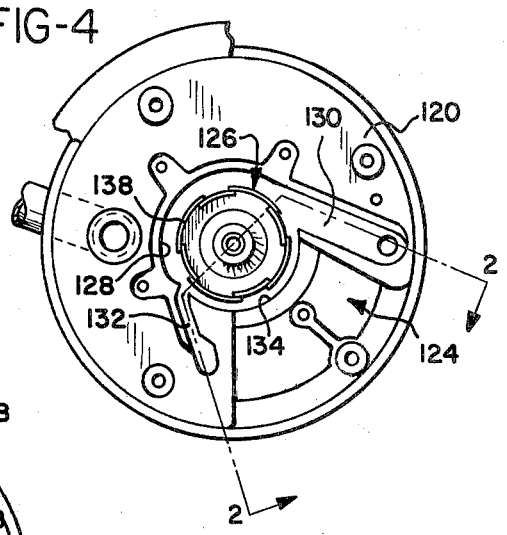
FIG. 4 is a plan view of the lower housing base plate of the embodiment of FIG. 2 taken at line 4—4 of FIG. 2.
Figure 12:
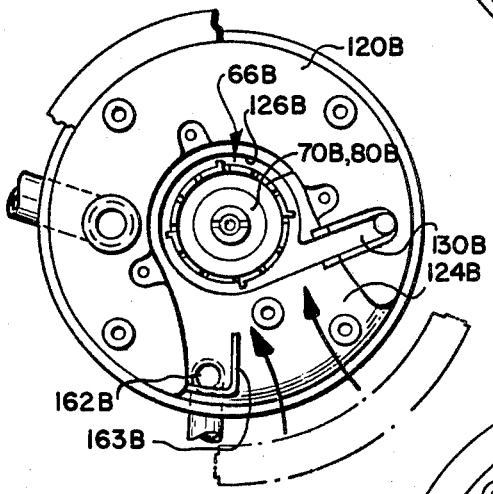
FIG. 12 is a plan view of the lower housing base plate of the embodiment of FIG. 11 taken at lines 12—12 of FIG. 11.

As shown in FIGS. 2, 3, and 4, the fluid inlet conduit 84, the segment of the soil collecting circuit between the circuit inlet 80 and collector body 82, is contained within the pump housing 64. Pump housing 64 includes a lower housing base plate 120 and an upper section 122, which are essentially separated by divider plate 76. Plate 76 thus constitutes the fluid dividing line between the primary spray means and the drain system. Base plate 120 defines a passageway 124 which comprises a continuation of the sump 62 beneath the upper section 122 to the circuit inlet 80. The drain pump 66, which is contained within the base plate 120, includes a pump chamber 126 defined by a circular wall 128, a drain channel 130, and a soil collector channel 132. The drain channel 130 forms a part of the drain line 68 and the collector channel 132 provides an entranceway to part of the common fluid channel 137. The wall 128 includes a wall section 134 between drain channel 130 and soil collector channel 132, and beneath passageway 124, which defines an arc having a radius of curvature less than that of the remainder of the wall.

As shown in FIGS. 2 and 3, the upper section 122 includes a vertical extension 135 which defines the collector chamber 100. Collector chamber 100 includes a floor 136 which slopes toward the fluid inlet opening 98 to facilitate draining the chamber 100. A common fluid channel 137, which forms an integral part of the fluid inlet conduit 84, extends vertically downward from the inlet opening 98.

As shown in FIG. 4, a combination drain impeller and food disposer 138 is mounted within chamber 126 and has a diameter such that a constriction is formed between the wall section 134 and the outer periphery of the impeller. As shown in FIGS. 6A and 6B, the impeller 138 includes a circular base 139 having a plurality of upturned, overlapping teeth 140 about its periphery. Teeth 140 are overlapped to form outer and inner opposing edges 142, 144 which provide blade-like surfaces or vanes for propelling fluid about the recess 126 in both forward and reverse directions of rotation. Additionally, internal opposing edges 144 provide moving cutting edges of a food disposer. Impeller 138 includes a plurality of holes 146 formed in the base 139 and spaced in a circular pattern about a hub 148. The holes 146 provide means for fluid and comminuted food soil flowing downwardly through the impeller 138 to flow beneath the base 139 and outside of the teeth 140 to be propelled either to the drain channel 130 or the soil collector channel 132. Lugs 150 formed on the underside of the base 139 and extending radially from the hub 148 also urge fluid beneath the impeller 138 to the wall 128. The base 139 also includes upwardly extending breakers 152 which carry soil to and force it against a stationary cutting tooth 153 depending from a cover plate 154 (FIGS. 2 and 5).

Figure 5:
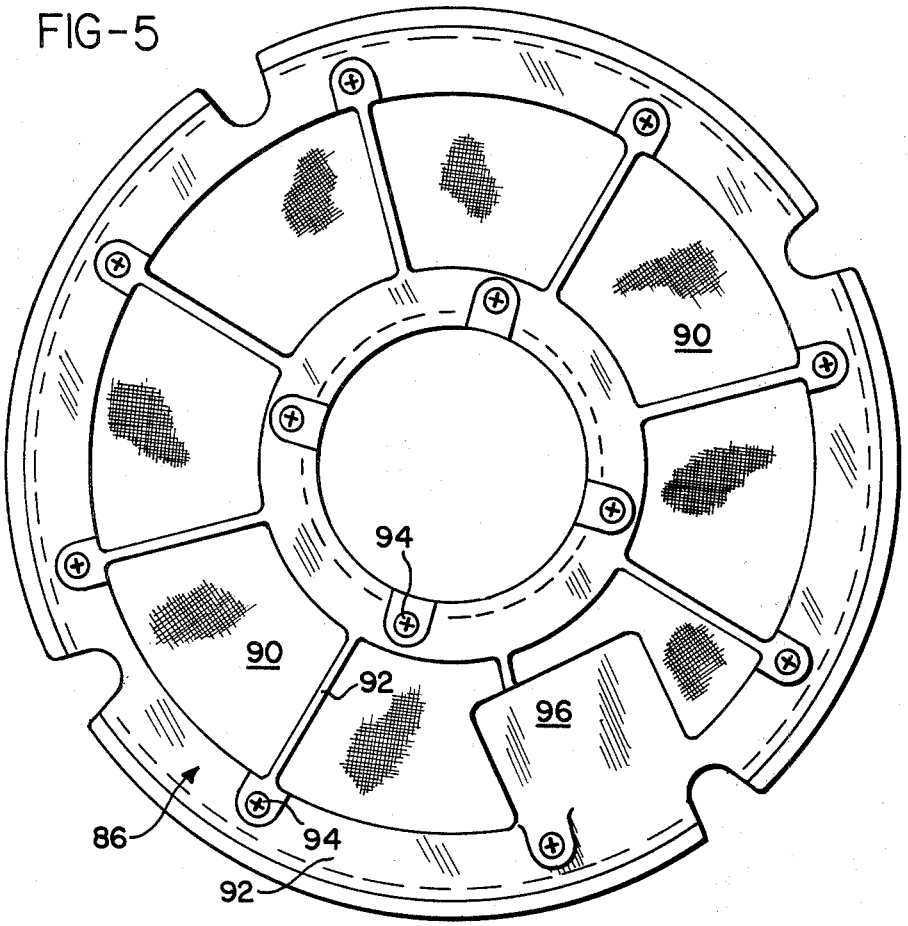
FIG. 5 is a plan view of a screen used to cover the soil collector body of the preferred embodiment of FIG. 1.
Figure 6A:
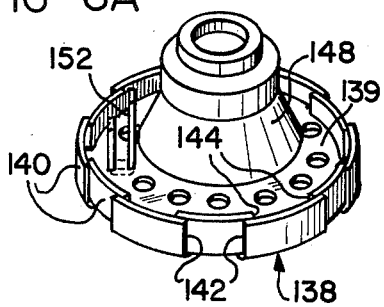
FIGS. 6A and 6B are perspective views of the drain impeller of the preferred embodiment of FIG. 1.
Figure 6B:
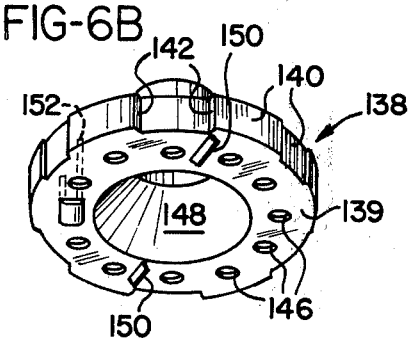

As shown in FIGS. 2, 3, and 5, the impeller 138 is covered by the cover plate 154 having an opening 156 concentric with the impeller which comprises the soil collecting circuit and drain system inlets 80, 70 respectively. Cover plate 154 includes a first arm 157 which covers the drain channel 130 and a second arm 158 extending over the soil collector channel 132. Second arm 158 defines a circular cut-out 160 which forms a nozzle 162 with the curved wall 164 of the base plate 120. Nozzle 162 is partially shielded from fluid flowing along the passageway 124 by a shield 163 which also guides fluid to the cover plate opening 156. The opening 156 is bordered by a downturned rim 166 which promotes flow of fluid downwardly onto the base 139 of the impeller 138. A portion of rim 166 supports the stationary cutting tooth 153.

The common fluid channel 137 extends downwardly from the inlet opening 98 in the collector body 82 to a point slightly above the nozzle 162, forming a gap in the fluid inlet conduit 84 above the nozzle which is in fluid communication with the passageway 124 segment of the sump 62. An opening 155 is formed in divider plate 76 to provide for fluid and soil flow between nozzle 162 and inlet opening 98.

Figure 7:
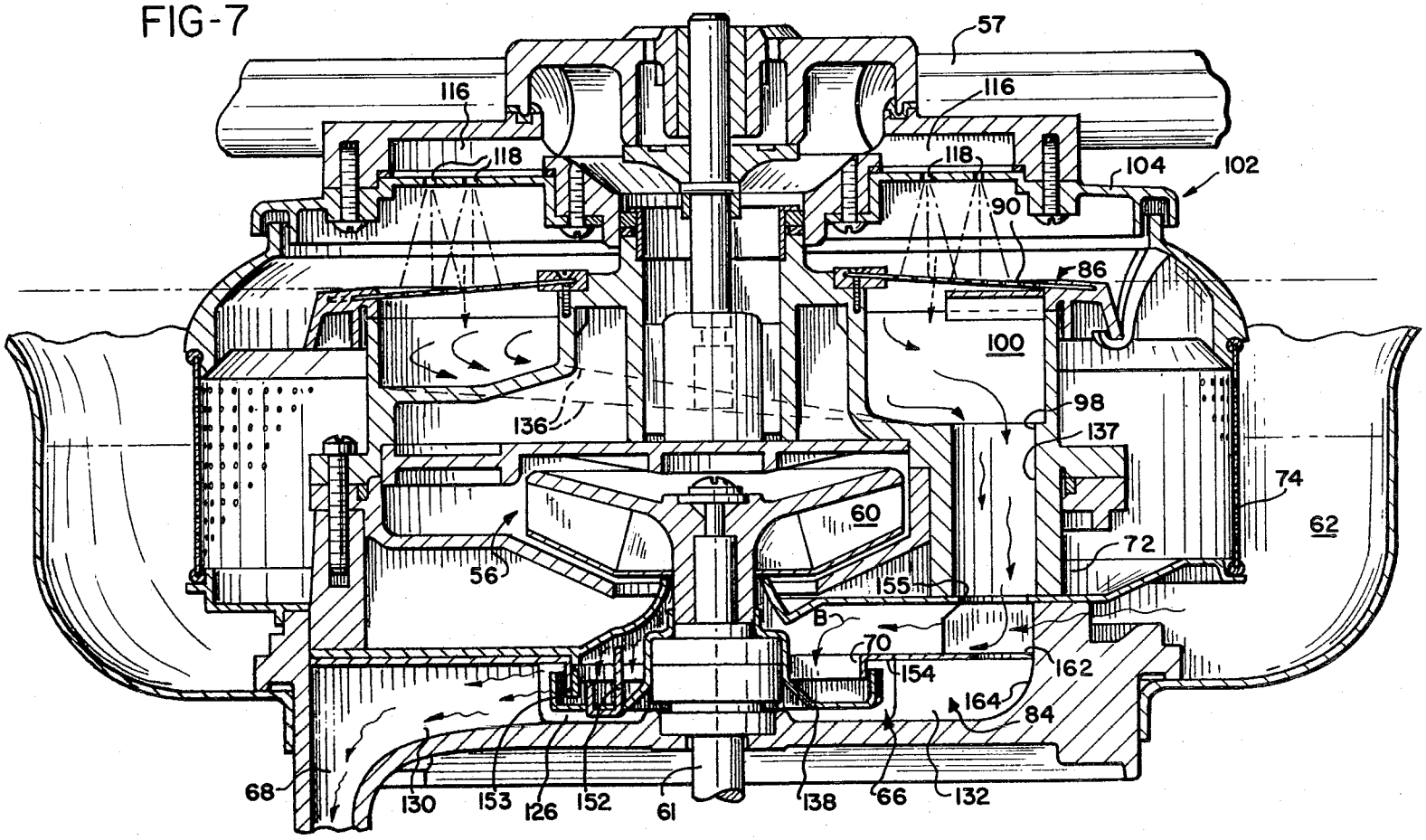
FIG. 7 is the elevation in section of FIG. 2 showing the fluid path during the soil draining mode.

The operation of the invention is shown in FIGS. 2 and 7 and is as follows. When the dishwasher is operated in a washing or rinsing cycle, the primary spray means operates in a fluid recirculating mode in which it recirculates and sprays fluid from the sump 62 onto the food ware. The recirculating pump 56 is activated by the drive motor so that the recirculating pump and impeller 60 draws fluid through the recirculating pump inlet 72 and pumps it up through the pump housing 64 to the spray arms 57. Fluid entering the spray arms 57 exits small holes formed in the arms (not shown) and is sprayed upon the food ware in a manner well-known in the art. The fluid entering the recirculating pump inlet 72 from the sump 62 is strained through the main filter screen 74 so that the larger food soil remains within the sump and only filtered fluid is pumped by the impeller 60 to the spray arms 57.

At the same time the recirculating pump 56 is operating in the recirculating mode, the drain pump 66 is operating in a soil collecting mode to collect all soil particles large enough to enter the passageway 124. The drain pump impeller 138 rotates in a forward mode with the recirculating pump impeller 60 on the drive shaft 61, thereby pumping fluid flowing onto the impeller base 139 from soil collecting circuit inlet 80 along the soil collecting channel 132 of the fluid inlet conduit 84. The fluid path is shown by dashed arrows A in FIG. 2. Fluid pumped along the fluid inlet conduit 84 is accelerated as it passes through the nozzle 162 and is directed upwardly along the common fluid channel 137, through the fluid inlet opening 98, and into the soil collecting chamber 100 of the soil collector body 82.

The fluid pumped along the fluid inlet conduit 84 is drawn from the sump 62 and flows through the passageway 124 of the sump, over the plate 154 and through the opening 156, which defines the inlet 80 of the soil collecting circuit 78. Food soil suspended in the fluid entering the opening 156 is comminuted by the tooth 153 and cutting edges 144 of the drain impeller 138 before passing through the holes 146 and into the portion of the pump chamber 126 beneath the impeller. The wall section 134, which forms a tight clearance with the drain impeller 138, allows minimum water slippage therealong. The wall 128 immediately adjacent channels 130 and 132 and outside section 134, has a greater radius of curvature than the section 134, forming an expansion area which creates a velocity-induced pressure differential. The design of the constriction may be varied in clearance to provide a slight negative or a slight positive pressure at the drain channel 130, and a large positive pressure at the soil collecting channel 132. A check valve (not shown) may be provided in drain line 68 adjacent channel 130, however, to prevent water in the drain line from re-entering the dishwasher.

The relatively high pressure and high velocity stream fluid exiting from the nozzle 162 and traveling upwardly along the common fluid channel 137 tends to draw along with it fluid and suspended food soil present in the passageway 124 in the immediate region surrounding the shield 163 which partially encloses the gap. The nozzle 162 thus acts as an injection pump by entraining fluid and food soil from the sump within a stream of fluid entering the soil collector body 82.

Once the fluid and suspended food soil enters the soil collector body 82, it impinges upon a deflector plate 96 and is diverted from its substantially vertical path to a substantially horizontal path around the circular soil collector chamber 100. As chamber 100 is pressurized, the nylon mesh 90 of screen 86 can bulge or billow slightly, thus enabling it to stay essentially free of minerals introduced with the wash water. The retentivity of nylon in effect permits the mesh 90 to flex between pressure and non-pressure conditions.

As the collector chamber 100 fills with fluid and food soil, the fluid exits the fluid outlet 88 of the soil collector 82 and is strained through the screen 86, thereby leaving the food soil within the collector chamber. The strained fluid, now substantially free of soil particles, travels over the sides of the screen 86 and downwardly beneath the shroud 102. The fluid is deposited in the drain recirculating inlet 72 between the upper section 122 of the pump housing 64 and the main filter screen 74. Thus, the effluent of the soil collecting chamber 100 is isolated at all times from the sump 62 until it enters the recirculating pump inlet 72. This additional fluid supplied to the recirculating pump inlet 72 reduces the volume of fluid required to pass through the main screen 74 from the sump 62, thereby reducing the load on the main screen and the possibility of the main screen becoming clogged during washing and rinsing. Food soil is retained within the chamber 100 since the relatively high velocity stream of fluid entering the inlet 98 prevents reverse flow of soil through the inlet.

During the soil collecting mode, a portion of the fluid pumped through the recirculating pump 56 enters the conduits 116 formed in the inner member 104 of the shroud means 102 and communicating with the primary spray arms 57 where it passes through the orifices 118 and is directed upon the upper surface of the screen 86. As the primary spray arms 57 rotate during the recirculating mode, the spray jets formed by the orifices 118 traverse the nylon mesh 90 of the screen 86 to backflush the mesh and prevent clogging of the mesh by food soil retained within the soil collector body 82. The nylon mesh 90 has a degree of flexibility, allowing it to bulge slightly when chamber 100 is under pressure. This provides an inherent self-cleaning aspect to the screen 86, preventing water minerals from gathering on the screen and reducing its effectiveness. In addition, the shroud means 102 prevents utensils amd large food soil from falling onto the screen 86 and damaging it. Accessibility to screen 86, if cleaning or replacement is required, is obtained by merely lifting spray arms 57 to remove them and member 104 from shaft 58. Additionally member 106 may be unsnapped at prongs 110 for removal of it and screen 74, all without tools.

When the dishwasher 50 is operated in a drain cycle, as shown in FIG. 7, the primary spray means and recirculating pump 56 continues to operate in a fluid circulating mode. In this mode, the pump motor reverses the direction of its rotation of the drive shaft 61, thereby causing the circulating pump impeller 60 and drain pump impeller 138 to reverse rotation. With regard to the recirculating pump 56, the symmetric configuration of the pump and impeller 60 cause the recirculating pump to function in the same manner as during the recirculating mode to pump fluid from the pump inlet 72 through the primary spray arms 57 and conduits 116 within the inner member 104 of the shroud means 102. This action continues to spray fluid upon the food ware and continues to backflush the nylon mesh 90 of the screen 86 until the water level in the sump is below the inlet to pump 56.

However, due to the aforementioned geometry of the drain pump chamber 126 and drain pump impeller 138, reverse rotation of the drain impeller causes the fluid entering the drain pump inlet 70 (shown as arrows B) to be swirled in an opposite direction and pumped along the drain channel 130 to the drain line and ultimately to a drain. The soil collector channel 132 now goes under a slight negative pressure. Accordingly, the soil collecting circuit 78 operates in a soil discharging mode as the collector fluid and retained food soil within chamber 100 flow across the downwardly sloping floor 136 and into the fluid inlet opening 98.

Fluid and food soil continue to flow downwardly along the common fluid channel 137 and enter the gap between the common fluid channel and the nozzle 162. At this point, the fluid and food soil will tend to follow the path of least resistance and flow along the plate 154 and re-enter the drain pump 66 through the drain pump inlet 70, again becoming comminuted by tooth 153 and cutting edges 144 prior to entering the drain channel 130. Thus, the common fluid channel 137 provides a conduit for upward fluid flow from the drain pump 66 to the soil collector body 82 during the soil collecting mode and downward flow of fluid and food soil from the collector body to the drain pump in the soil draining mode. Therefore, the common fluid channel 137 provides a conduit for bi-directional fluid flow during a wash cycle.

Flushing of the collector chamber 100 is effected by the orifices 118 of the spray jets which supply filtered fluid to the mesh 90 which flows through the mesh and into the collector body 82 to provide a liquid medium to convey the collected food soil back to the fluid inlet conduit 84. This backflushing action continues until the fluid level within the sump drops below the inlet 72 of the recirculating pump 56 whereupon the recirculating pump air bends from lack of water to pump. At this time, the drain pump inlet 70, which is located beneath the recirculating pump inlet 72, continues to receive fluid from the sump and suspended food soil within the fluid, helping to flush the food soil flowing downwardly from the soil collector 82 to the drain pump 60. Thus, all food soil removed from the food ware within the dishwasher is ground at least once by the drain impeller/-food disposer 138 prior to entering the drain channel 130 and drain line, even though it may have originally entered the collector chamber 100 as a result of the jet pump action issuing from nozzle 162. That food soil which entered the drain pump 66 during the soil collecting mode and was ground prior to being stored in the soil collector 82, is twice ground in the course of any given wash or rinse fill of a washing cycle, further enhancing draining of the soiled water.

Figure 10:
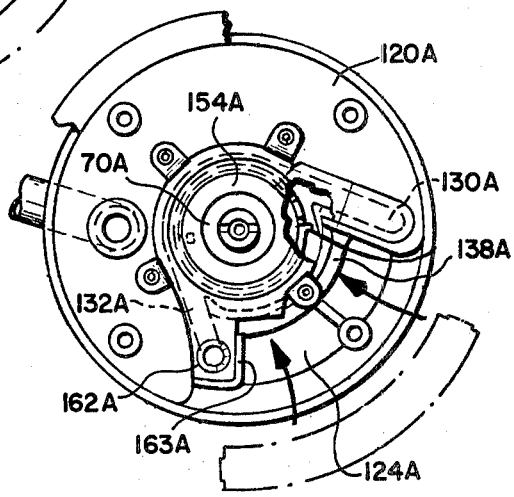
FIG. 10 is a plan view of the lower housing base plate of the embodiment of FIG. 8 in which the cover plate is partially broken away to show the drain impeller.
Figure 8:
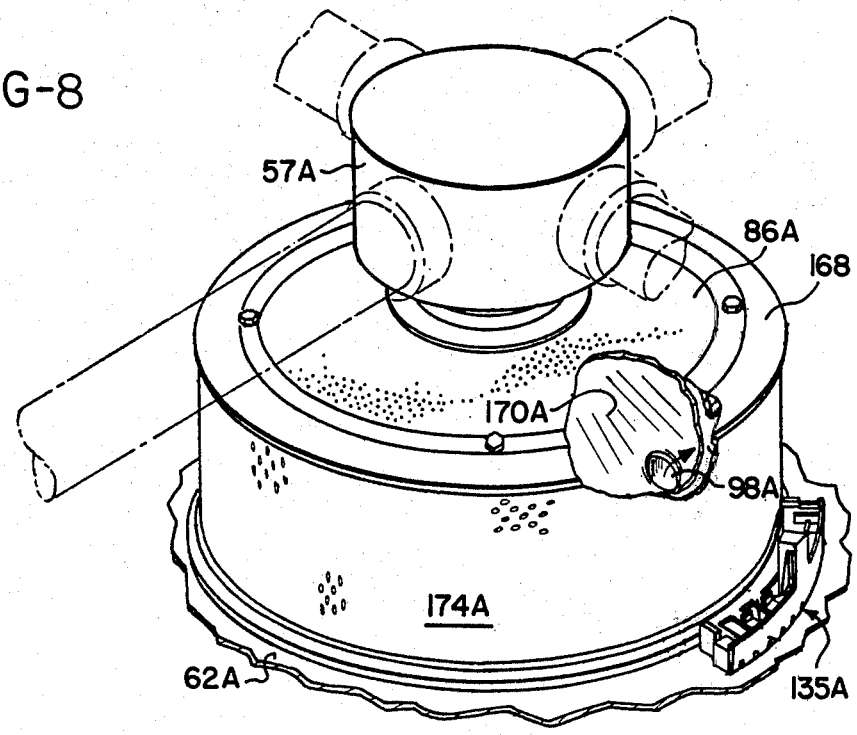
FIG. 8 is a perspective view of the soil collector and circulating pump of an alternate embodiment of the invention, partially cut away to reveal the interior of the soil collector body.
Figure 9:
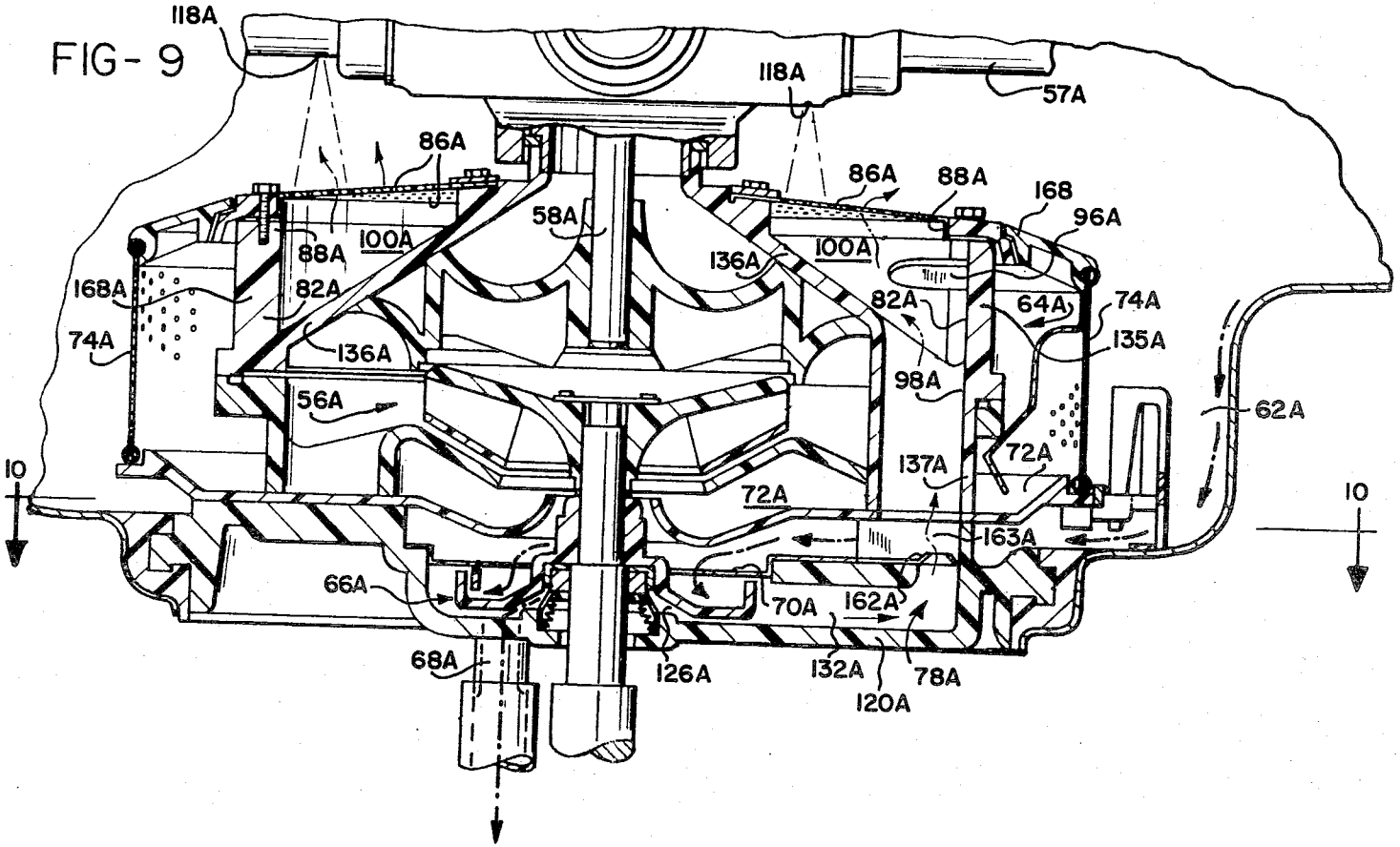
FIG. 9 is a side elevation in section of the soil collecting circuit and recirculating pump of the embodiment shown in FIG. 8.
Figure 11:
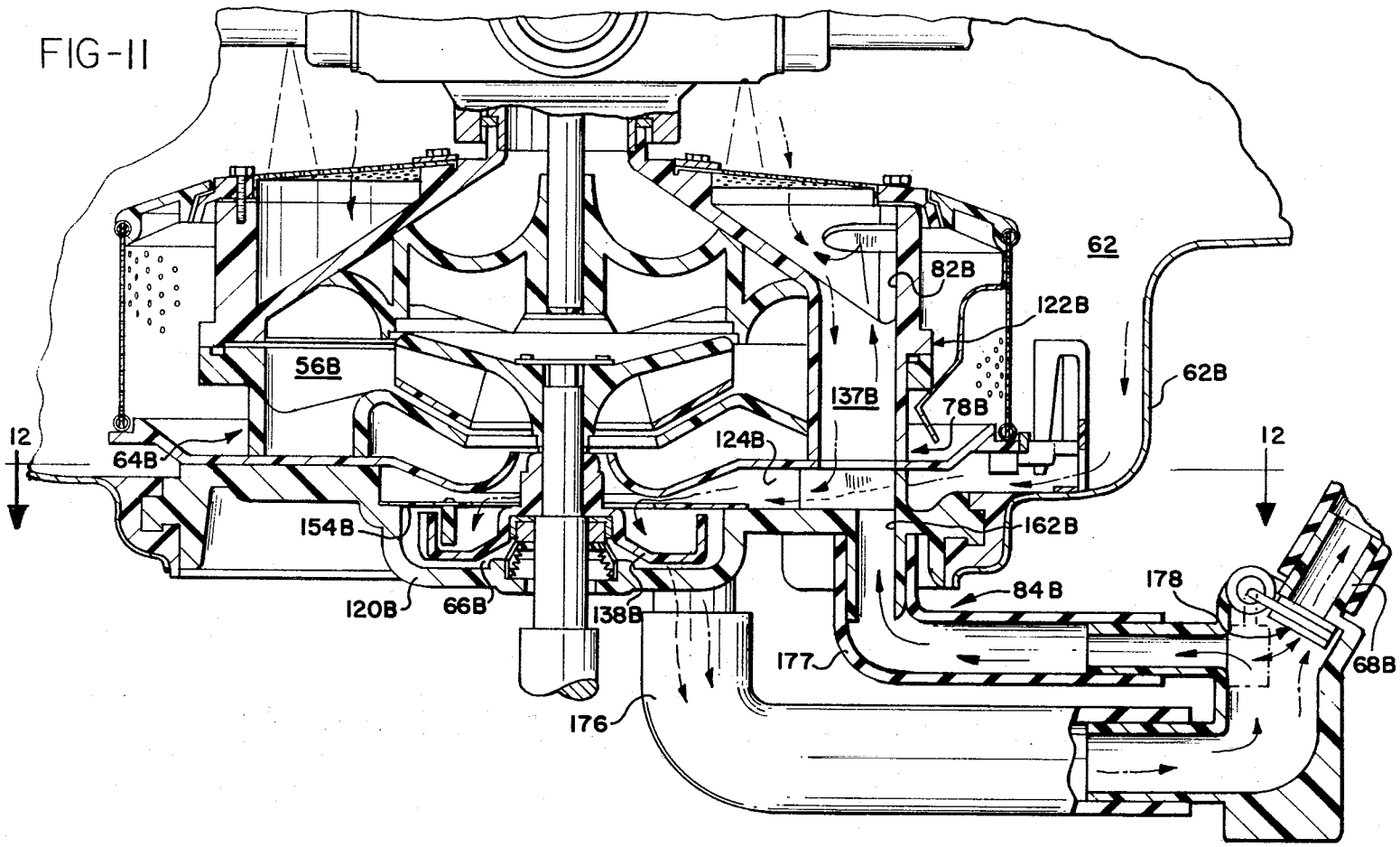
FIG. 11 is a side elevation in section of a second alternate embodiment of the invention.
Figure 13:
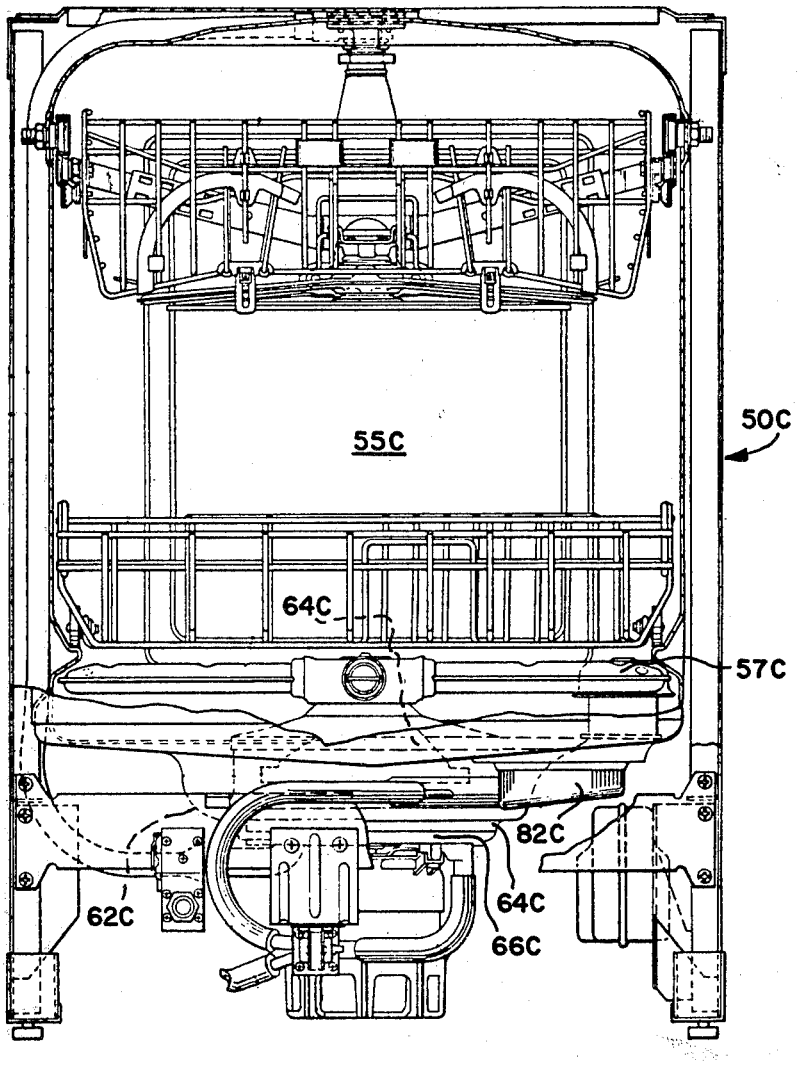
FIG. 13 is a partially broken away cross sectional elevation of a dishwashing machine including a soil collecting circuit according to another embodiment of the invention.
Figure 14:
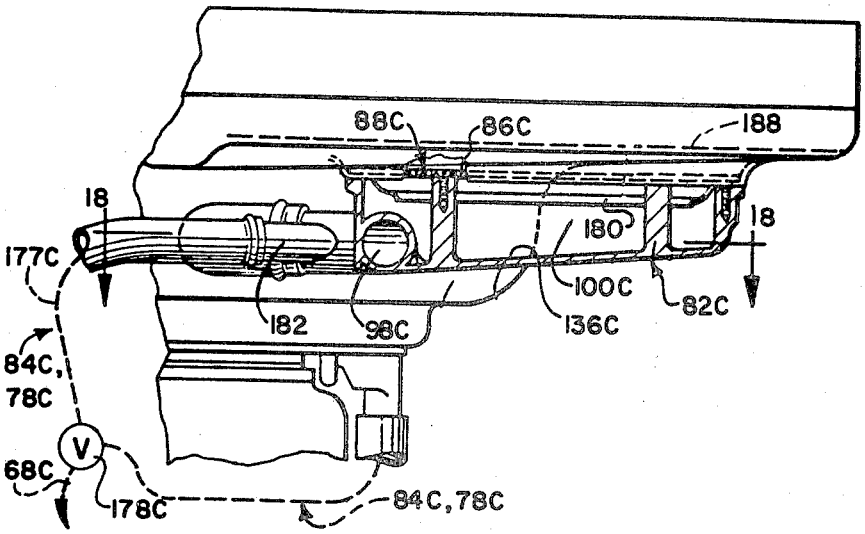
FIG. 14 is a cross sectional view of the soil collector body shown in FIG. 13, taken at line 14—14 of FIG. 15.
Figure 15:
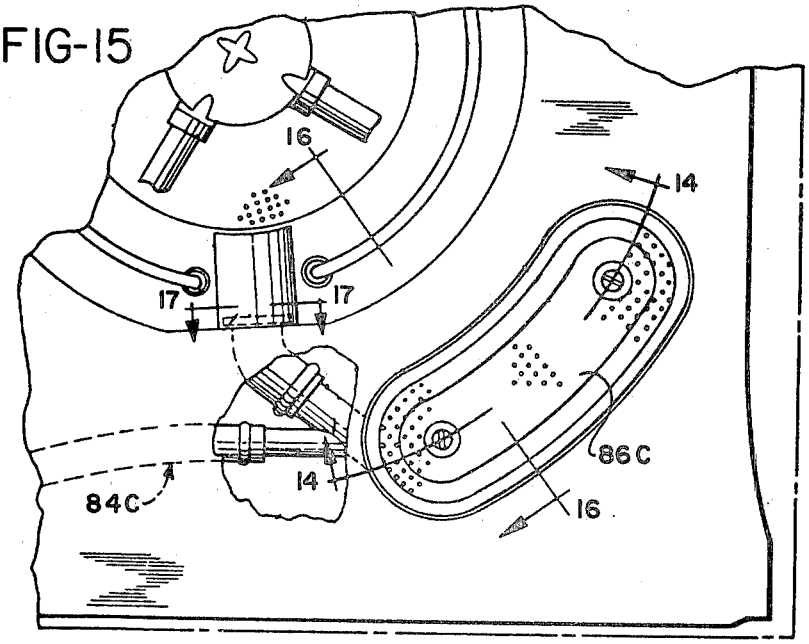
FIG. 15 is a top view of the soil collector body of the embodiment shown in FIG. 13.
Figure 19:
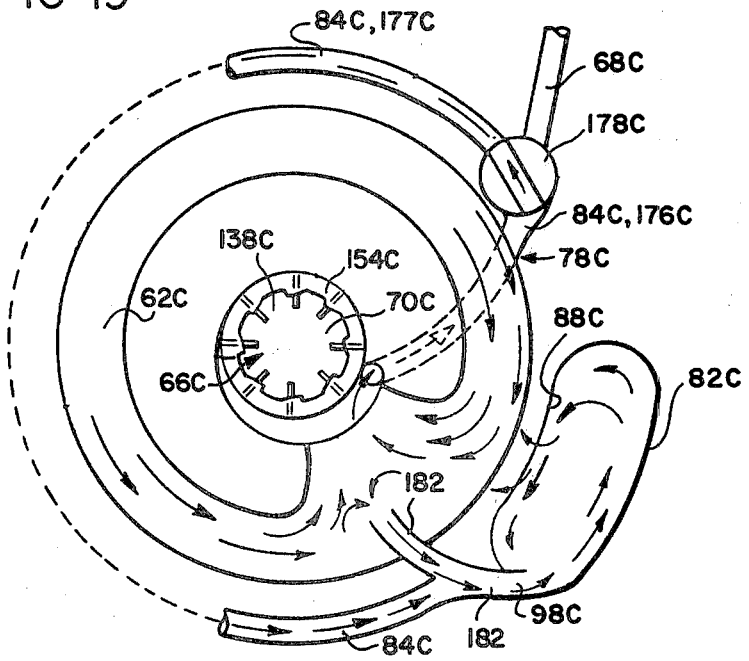
FIG. 19 is a somewhat schematic view of the soil collecting circuit of FIG. 13 during a wash or rinse mode in which the soil collecting circuit is in the soil collecting mode and the fluid path is shown by solid arrows.
Figure 20:
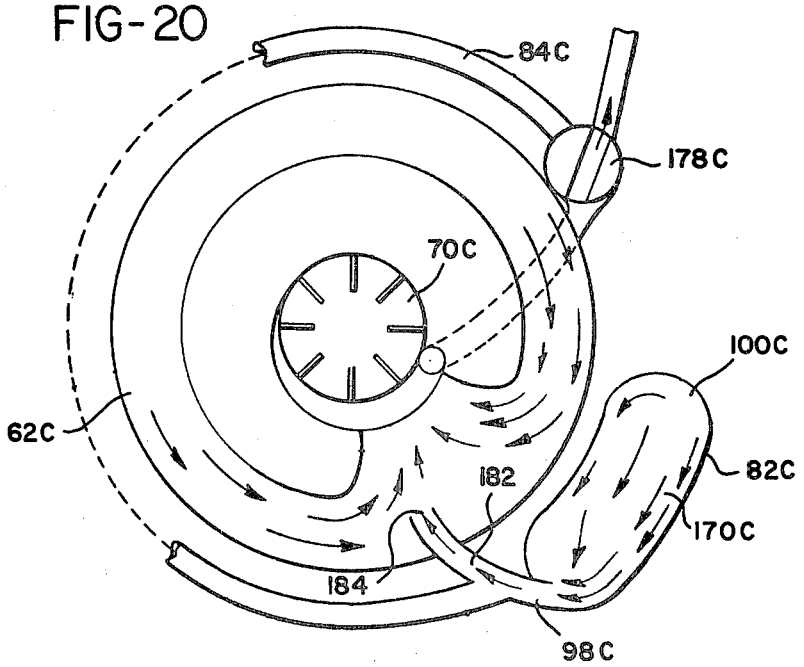
FIG. 20 is a view of the soil collecting circuit of FIG. 19 showing fluid flow paths by solid arrows during a draining period in which the soil collecting circuit is in the draining mode.

An alternate embodiment of the invention is shown in FIGS. 8, 9, and 10. This embodiment is similar in construction to the previously discussed preferred embodiment. Accordingly, those structural elements which perform the same functions in this alternate embodiment shall be given the same numbers as those used to denote the corresponding elements in the preferred embodiment, followed by the letter "A". As shown in FIGS. 8 and 9, the recirculating pump 56A and drain pump 66A together are housed within a pump housing 64A located at the bottom of the sump 62A of a dishwasher. Primary spray arms 57A are mounted for rotation on fixed shaft 58A within the pump housing 64A. Pump housing 64A includes a vertical extension 135A which defines the soil collector body 82A.

Soil collector body 82A also includes a conical-shaped floor 136A which separates it from the volutes of the recirculating pump 56A. The floor 136A defines a fluid inlet opening 98A, located at the portion of the floor having the lowest elevation, and communicating with a common fluid channel 137A. The fluid outlet 88A of the collector body 82A is enclosed by a screen 86A. The vertical extension 135A supports an annular flange 168 which extends about the periphery of the screen 86A and engages the upper edge of a main filter screen 74A. The vertical extension 135A also supports a deflector plate 96A which is positioned above the fluid inlet opening 98A.

The alternate embodiment shown in FIGS. 8, 9, and 10 is distinguishable from the preferred embodiment in that it lacks the shroud structure of the preferred embodiment. Rather than having an inner annular member which defines spray jets, the spray arms 57A themselves include orifices 118A which direct fluid from within the spray arms downwardly onto the upper surface of the screen 86A to backflush the screen during the soil collecting mode and to facilitate flushing of the collector chamber 100A during the soil draining mode.

A second distinction between the alternate embodiment and the preferred embodiment is that, with the alternate embodiment, the main screen 74A is enclosed by the annular flange 168 so that the effluent from the soil collector 82A cannot return to the recirculating pump inlet 72A without again passing through the screen 74A.

As shown in FIGS. 9 and 10, the construction of the lower housing base plate 120A is similar to its counterpart in the preferred embodiment. The base plate 120A defines a passageway 124A which comprises an extension of the sump 62A beneath the recirculating pump 56A and over a cover plate 154A. The cover plate 154A covers the recess 126A which houses the drain pump impeller 138A. The drain pump recess 126A includes a drain channel 130A and a soil collecting channel 132A. Thus, the alternate embodiment includes a soil collecting circuit 78A which begins at the drain pump inlet 70A and extends along the soil collector channel 132A, upwardly through the nozzle 162A and common fluid channel 137A and terminates at the fluid outlet 88A of the soil collector body 82A. The nozzle 162A is formed in the cover plate 154A and is shielded from fluid flowing through the passageway 124A by a shield 163A formed in the base plate 120A.

When a dishwasher having the pump and collector system of the alternate embodiment is operated in a wash or rinse cycle, fluid enters the passageway 124A and into the soil collecting circuit 78A, where it is pumped by the drain pump 66A along the fluid inlet 15. The combination of claims 10 or 11 wherein said return outlet is in fluid communication with said wash chamber.

16. The combination of claim 15 wherein said primary spray means includes spray arms mounted above and in fluid communication with said recirculating pump, said spray arms including said spray jet means; and said soil collector body is positioned beneath said spray arms such that said spray jet means directs a jet downwardly upon an exterior surface of said soil collecting filter.

17. The combination of claim 16 further comprising a pump housing concentric with and located beneath said spray arms within said sump, said housing enclosing said wash pump, said drain pump, and said soil collector body.

18. The combination of claim 11 wherein:

(a) said wash chamber includes means defining an opening in the bottom thereof;

(b) said soil collector body has a hollow interior and is attached to said wash chamber bottom opening so as to cover the underside thereof; and (c) said soil collecting filter further comprises a fine mesh screen at the interface between said soil collector body hollow interior and said wash chamber opening.

19. The combination of claim 18 further comprising means extending toward said drain pump inlet from said debris outlet for guiding food soil particles directly from the former to the latter, to minimize dispersion of the discharged debris into said wash chamber sump.

20. The combination of claim 2 wherein said soil collector body is positioned below an average static fluid level in the wash chamber for retaining the collected food soil debris in said soil collector body during interruption of the operation of the warewashing machine while the fluids are therein.

21. A method of washing soiled food ware supported on racks in a chamber of a dishwasher, comprising the steps of:

filling a sump at the bottom of said chamber with a wash solution, thereby initiating a soil collecting cycle;

spraying said food ware and flushing soil therefrom to said sump by pumping said solution under pressure from said sump through spray arms with a recirculating pump, thereby forming a soil laden solution in said sump;

ingesting said soil laden solution from said sump during said soil collecting cycle and passing said soil laden solution through a soil collecting circuit independent of said recirculating pump;

filtering soil particles from said soil laden solution in said circuit to collect and retain said filtered particles within said circuit thereby preventing reentrance of said filtered particles into said chamber during said soil collecting cycle and returning supernatant from said circuit for recirculation by said spray arms; and upon completion of said soil collecting cycle, emptying said circuit of collected soil particles into said sump for draining the solution and said soil particles therefrom.

22. A method according to claim 21 including the additional step of first filtering said solution pumped through said recirculating pump by means of a first filter, and wherein said filtering in said circuit is accomplished with a second filter finer in mesh than said first filter.

23. A method according to claim 22 wherein said supernatant from said circuit is returned for recirculation to said recirculating pump at a location downstream of said first filter.

* * * * * when the machine is being operated. Level 188 is above the level of the fluid outlet 88C, defined by the fine mesh screen 86C. During such an interruption, therefore, the soil collector body 82C and chamber 100C will remain entirely submerged. This means that there will be no fluid flow into or out of the soil collector during such an interruption, and the collected food soil debris will automatically be retained within the chamber 100C.

On the other hand, while fluid is being drained from the warewashing machine through drain line 68C, substantially all fluid will be simultaneously drained from the chamber 100C. This is a result of the sloped floor 136C and also the relative elevations (see FIG. 16) of the opening 98C, the debris outlet conduit 182, and the drain pump inlet 70C. That is, outlet 182 is below opening 98C, and is at least as high as inlet 70C, so that the fluids readily flow downwardly out of compartment 80 and into the drain pump 66C. As they flow out they carry the collected food soil directly into the drain line 68C as described above.

As shown in FIG. 16, orifices 118C forming fluid spray jets are provided on the bottom of at least one of the spray arms 57C. The orifices 118C are positioned and aimed for spraying fluid onto the soil collector fine mesh screen 86C through the wash chamber bottom opening 180. As discussed with the previous embodiments, the primary objective is to maintain the screen open for passage of water therethrough. Additionally, it assists in flushing the soil collector chamber 100C with at least a portion of the fluid in the warewashing machine as the collected food soil is being discharged from the chamber into the outlet conduit 182 during the draining mode.

Figure 21:
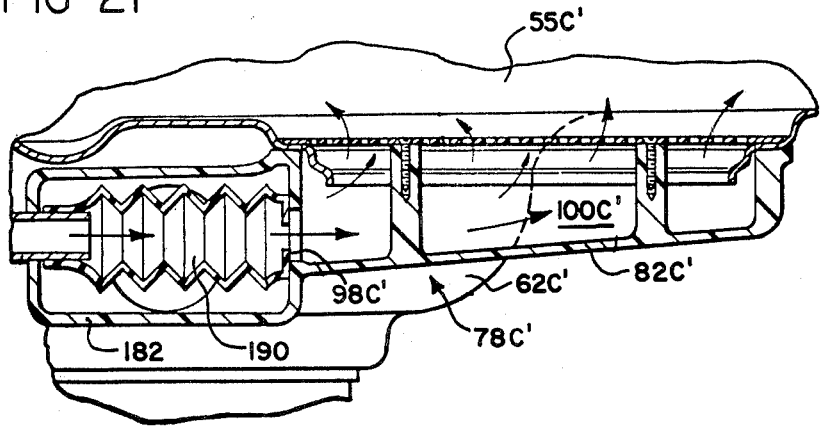
FIG. 21 is a cross sectional elevation of another embodiment of the invention.
Figure 22:
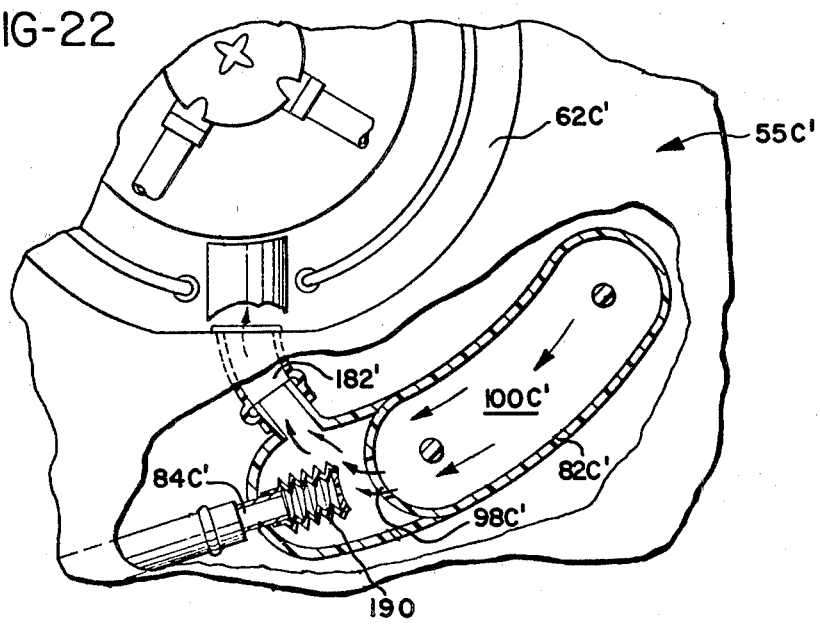
FIG. 22 is cross sectional plan view taken of the soil collector shown in FIG. 21.

FIGS. 21 and 22 illustrate in yet another embodiment a soil collecting circuit 78C' which is similar to soil collecting circuit 78C in construction of the drain pump, single fluid channel, and connecting conduit. However, circuit 78C' has a fluid inlet conduit 84C' which terminates in a pressure operated bellows 190 as it joins the debris outlet conduit 182'. In this embodiment, outlet conduit 182' is distended proximate the inlet conduit 84C' so that the inlet conduit opens directly before the collector opening 98C'. As the two conduits 84C' and 182' merge, they communicate with the soil collecting chamber 100C' through a common opening 98C'.

The bellows 190 is suitably sized, positioned, orificed and connected so that when operated in the soil collecting mode the pressure of the fluid supplied to the bellows by the drain pump (not shown) through the fluid inlet conduit 84C', causes it to respond to the pressure of the fluid by expanding across and sealing the common opening 98C'. Chamber 100C' and the screen 86C' are the separating and connecting means for collector body 82C', similarly as in the immediately preceding embodiment. When the circulating means is operating in the fluid draining mode and the soil collector is therefore operating in the soil discharging mode, as illustrated in FIG. 22, pressure is removed from bellows 190 and it retracts away from opening 98C'. This allows the fluid and collected food soil in chamber 100C' to flow out through the debris outlet conduit 182' to the sump 62C' as the fluids are drained from the dishwasher wash chamber 55C'.

Figure 23:
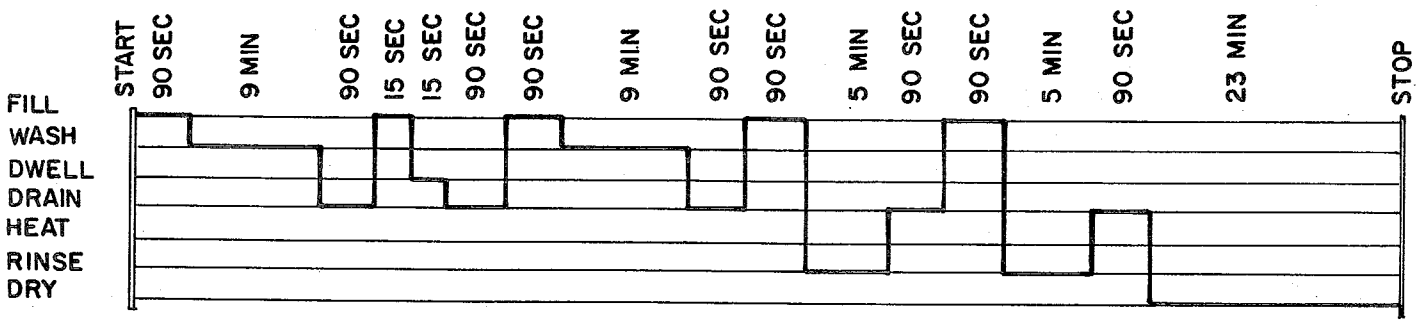
FIG. 23 is a chart illustrating a typical operational sequence or machine cycle for a domestic dishwashing machine incorporating the soil collecting circuit according to the invention.
Figure 24:
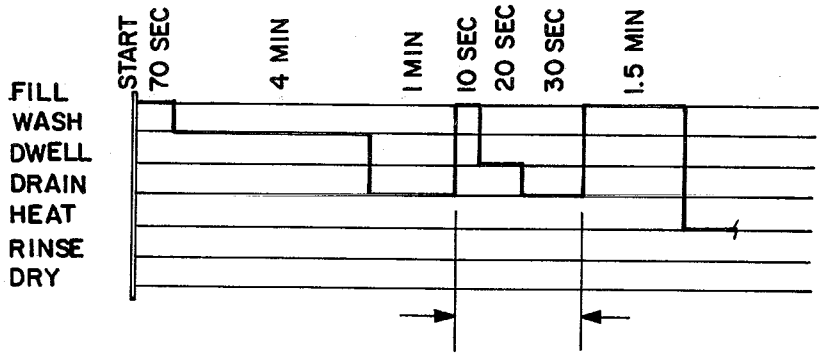
FIG. 24 illustrates a variation of the cycle shown in FIG. 23.

FIG. 23 illustrates a typical wash cycle sequence for a dishwasher such as those previously discussed. This chart is self-explanatory, showing a sequence of operations such as fill, wash and drain. FIG. 24 shows the first several minutes of the cycle of FIG. 23, to which an optional short purge cycle has been added. The balance of the FIG. 24 cycle is the same as the balance of the FIG. 23 cycle.

The optional cycle shown in FIG. 24 is particularly advantageous for use with a dishwasher having a soil collecting circuit. In this cycle, the soil collector body receives a very quick purge to remove any food soil which might remain following a normal drain cycle. First, it should be noted that both the drain pump and recirculating pump are normally operated while fluid is being introduced into wash chamber during a fill period in the operation of the dishwasher. Since the drain pump inlet is preferably located at the very bottom of the sump, the first fluid introduced into the wash chamber will be circulated through the soil collecting circuit and into the soil collector body. Due to the operation of the nozzle 162 etc., the collector chamber will quickly fill with fluid.

If, before sump has begun to fill, the dishwasher is then switched to the drain mode of operation, the level of fluid in the collector chamber will be well above that in the sump, and the fluid will rush out of the chamber, through the common fluid channel, and into the sump adjacent the drain pump inlet. This rapid outflowing of the fluid will flush most of the food which may remain in the chamber through the drain line. Therefore, is possible to provide the timer for the dishwasher with a short fill cycle comprising substantially less than the average amount of wash or rinse fluid which is supplied during a normal wash or rinse period. The timer would then operate the drain pump to fill chamber with fluid from the short fill, following which the drain system would be operated to drain the fluid from the dishwasher.

While the methods herein described, and the forms of apparatus for carrying them into effect, constitute preferred embodiments of this invention, it is to be understood that the invention is not limited thereto, and that changes may be made therein without departing from the scope of the invention.

What is claimed is:

1. In a dishwasher which utilizes multiple fluid fills for sequentially washing and rinsing food ware items during a complete cycle, said dishwasher having a wash chamber including rack means for receiving and supporting food ware therein and a sump at the bottom of said chamber for containing fluid therein; primary spray means including a wash pump operable in a recirculating mode for recirculating and spraying fluid onto food ware items to remove food soil particles therefrom and carry food soil particles to the sump; a drain system having a drain pump inlet adjacent the bottom of said sump, a drain outlet communicating with a drain, and a drain pump operable in a draining mode for pumping fluid and food soil particles therein from said pump to said drain outlet at intervals between successive fluid fills; and soil collector means for continuously collecting and removing food soil particles from fluid in said sump during said recirculating mode; the improvement comprising:

(a) said soil collector means comprising a soil collecting circuit having a circuit inlet connected to receive fluid from said sump, a return outlet located within said wash chamber, and a portion, independent of said primary spray means and said wash chamber, in fluid communication with said circuit inlet and said return outlet;

(b) said portion including a relatively fine screen soil collecting filter for removing food soil particles from fluid circulating through said soil collecting circuit to be retained within said portion during said recirculating mode, said filter having its upstream side in position to have collected soil particles flushed therefrom to said sump during said draining mode;

(c) flow direction control means for establishing bidirectional fluid flow between said sump and said portion, said control means being operable for directing fluid and food soil particles in a first direction from said sump to said portion during said recirculating mode, and being operable for directing fluid and debris in a second direction from said portion to said sump during said draining mode; and (d) means for selectively controlling said dishwasher to operate said primary spray means and said drain system in either a recirculating mode or in a draining mode.

2. The combination of claim 1 wherein said portion includes a soil collector body for retaining food soil particles separate from said wash chamber during said recirculating mode, and said filter is positioned between said collector body and said return outlet.

3. The combination of claim 2 wherein:

said soil collector body includes a debris outlet which constitutes a common fluid channel with said portion; and said soil collecting circuit includes a nozzle which directs fluid flowing therethrough into said common fluid channel during said recirculating mode.

4. The combination of claim 3 further comprising spray jet means, associated with said primary spray means, for directing a jet of fluid from said primary spray means upon said soil collecting filter, thereby continuously backflushing said soil collecting filter during said recirculating mode and said draining mode, thereby preventing build-up of food soil particles on said filter and assisting in the draining of food soil particles from said portion during said draining mode.

5. The combination of claim 4 wherein said flow direction control means includes valve means in said soil collecting circuit and said drain system for directing fluid flow from said sump through said soil collecting circuit to said portion during said recirculating mode and from said portion thence to said drain system to said sump in said draining mode.

6. The combination of claim 5 wherein said drain system further comprises means cooperating with said drain pump for grinding food soil particles carried by fluid pumped through said drain pump such that food soil particles are ground during said recirculating mode and during said draining mode, whereby all food soil particles flowing to said drain outlet from said sump have passed through said grinding means at least once.

7. The combination of claim 6 wherein said grinding means includes a drain impeller mounted within said drain pump such that upon controlled operation of said wash pump and drain pump said impeller can be rotated in a forward direction during said recirculating mode thereby pumping fluid from said sump through said nozzle, said common fluid channel and said soil collector body, or rotated in a reverse direction during said draining mode such that fluid is discharged from said soil collector body through said common fluid channel to said sump and therefrom to said drain means.

8. The combination of claim 7 wherein said primary spray means further includes a housing portion integral with said drain system and said soil collecting circuit and positioned below said spray arms, said housing portion having:

a circular recess sized to receive said drain impeller;

a first trough extending from said circular recess and integral with said drain system and said soil collecting circuit such that fluid entering said drain inlet during said recirculating mode is pumped through said first trough to said nozzle and said common fluid channel; and a second trough extending from said circular recess and integral with said drain system such that fluid entering said drain pump inlet during said draining mode from said sump is pumped through said circular recess and through said second trough to said drain outlet.

9. The combination of claim 8 wherein said second trough intersects said circular recess to form a stator member, said stator member extending from an outer peripheral wall of said circular recess toward said drain impeller thereby forming a constriction such that, as said impeller operates in a forward direction, said constriction causes a slight positive pressure in said second trough so that fluid in said circular recess does not flow through said second trough.

10. The combination of claim 8 wherein said drain pump inlet further includes a drain inlet plate disposed above said impeller and having a central opening concentric with said impeller such that fluid entering said drain inlet during said recirculating mode and said draining mode flows downwardly to said impeller.

11. The combination of claim 5 wherein said valve means comprises a flap valve for selectively diverting fluid flow from said drain pump to said soil collector body during said recirculating mode or to said drain outlet during said draining mode.

12. The combination of claim 1 or 10 wherein said primary spray means comprises a wash pump inlet in fluid communication with said sump for supplying fluid to said wash pump, a main screen enclosing and separating said wash pump inlet from said sump, and spray arms rotatably mounted above and in fluid communication with said wash pump; and said soil collecting circuit includes conduit means enclosing said return outlet and extending to said wash pump inlet at a location between said main screen and said wash pump inlet.

13. The combination of claim 12 wherein said conduit means includes shroud means positioned beneath said spray arms and being contiguous with said main screen.

14. The combination of claim 13 wherein said shroud means comprises:

an inner disc member mounted to said spray arms and capable of rotation therewith;

means forming a spray jet associated with said inner disc portion and communicating with said wash pump to receive fluid therefrom, said spray jet means oriented to direct a spray of fluid upon an exterior surface of said soil collecting filter; and an outer annular member mounted to said main screen to form a watertight seal therewith and having an inner periphery forming a labyrinth seal with said inner disc.

15. The combination of claims 10 or 11 wherein said return outlet is in fluid communication with said wash chamber.

16. The combination of claim 15 wherein said primary spray means includes spray arms mounted above and in fluid communication with said recirculating pump, said spray arms including said spray jet means; and said soil collector body is positioned beneath said spray arms such that said spray jet means directs a jet downwardly upon an exterior surface of said soil collecting filter.

17. The combination of claim 16 further comprising a pump housing concentric with and located beneath said spray arms within said sump, said housing enclosing said wash pump, said drain pump, and said soil collector body.

18. The combination of claim 11 wherein:

(a) said wash chamber includes means defining an opening in the bottom thereof;

(b) said soil collector body has a hollow interior and is attached to said wash chamber bottom opening so as to cover the underside thereof; and (c) said soil collecting filter further comprises a fine mesh screen at the interface between said soil collector body hollow interior and said wash chamber opening.

19. The combination of claim 18 further comprising means extending toward said drain pump inlet from said debris outlet for guiding food soil particles directly from the former to the latter, to minimize dispersion of the discharged debris into said wash chamber sump.

20. The combination of claim 2 wherein said soil collector body is positioned below an average static fluid level in the wash chamber for retaining the collected food soil debris in said soil collector body during interruption of the operation of the warewashing machine while the fluids are therein.

21. A method of washing soiled food ware supported on racks in a chamber of a dishwasher, comprising the steps of:

filling a sump at the bottom of said chamber with a wash solution, thereby initiating a soil collecting cycle;

spraying said food ware and flushing soil therefrom to said sump by pumping said solution under pressure from said sump through spray arms with a recirculating pump, thereby forming a soil laden solution in said sump;

ingesting said soil laden solution from said sump during said soil collecting cycle and passing said soil laden solution through a soil collecting circuit independent of said recirculating pump;

filtering soil particles from said soil laden solution in said circuit to collect and retain said filtered particles within said circuit thereby preventing reentrance of said filtered particles into said chamber during said soil collecting cycle and returning supernatant from said circuit for recirculation by said spray arms; and upon completion of said soil collecting cycle, emptying said circuit of collected soil particles into said sump for draining the solution and said soil particles therefrom.

22. A method according to claim 21 including the additional step of first filtering said solution pumped through said recirculating pump by means of a first filter, and wherein said filtering in said circuit is accomplished with a second filter finer in mesh than said first filter.

23. A method according to claim 22 wherein said supernatant from said circuit is returned for recirculation to said recirculating pump at a location downstream of said first filter.

* * * * *

UNITED STATES PATENT AND TRADEMARK OFFICE

CERTIFICATE OF CORRECTION

PATENT NO. : 4,392,891

DATED : July 12, 1983

INVENTOR(S) : Theodore F. Meyers

It is certified that error appears in the above—identified patent and that said Letters Patent is hereby corrected as shown below:

In the Prior Art list, "Brezosky" should be --Brezocky--.

Column 22, line 58, "pump" should be --sump--.

Column 24, line 43, "claim" should be --claims--.

Signed and Sealed this

*Eighteenth* Day of *October 1983*

[SEAL]

*Attest:*

GERALD J. MOSSINGHOFF

*Attesting Officer*

*Commissioner of Patents and Trademarks*